US005180656A

United States Patent [19]

Kobayashi et al.

[11] Patent Number: 5,180,656

[45] Date of Patent: Jan. 19, 1993

[54] METHOD FOR PROCESSING SILVER HALIDE COLOR PHOTOGRAPHIC LIGHT-SENSITIVE MATERIALS AND THE BLEACH-FIXER APPLICABLE THERETO

[75] Inventors: Hiroaki Kobayashi, Hino; Shigeharu Koboshi, Sagamihara; Masayuki Kurematsu, Hino; Masao Ishikawa, Tama, all of Japan

[73] Assignee: Konica Corporation, Tokyo, Japan

[21] Appl. No.: 775,244

[22] Filed: Oct. 31, 1990

Related U.S. Application Data

[63] Continuation of Ser. No. 385,385, Jul. 27, 1989, abandoned.

[30] Foreign Application Priority Data

Jul. 29, 1988 [JP] Japan ..... 63-190856

[51] Int. Cl.[5] ..... G03C 7/00

[52] U.S. Cl. ..... 430/393; 430/418; 430/460; 430/963

[58] Field of Search ..... 430/393, 963, 418, 460

[56] References Cited

U.S. PATENT DOCUMENTS

| | | | |
|---|---|---|---|
| 4,818,673 | 4/1989 | Ueda et al. | 430/393 |
| 4,822,726 | 4/1989 | Ikeda et al. | 430/393 |
| 4,828,970 | 5/1989 | Kuse et al. | 430/393 |
| 4,837,140 | 6/1989 | Ikeda et al. | 430/550 |
| 4,939,074 | 7/1990 | Ishikawa | 430/393 |
| 4,954,426 | 9/1990 | Ishikawa | 430/393 |
| 4,966,834 | 10/1990 | Ishikawa et al. | 430/393 |
| 5,006,456 | 4/1991 | Morigaki et al. | 430/393 |

*Primary Examiner*—Charles L. Bowers, Jr.
*Assistant Examiner*—Thomas R. Neville
*Attorney, Agent, or Firm*—Finnegan, Henderson, Farabow, Garrett and Dunner

[57] ABSTRACT

A method of processing a silver halide color photographic light-sensitive material and a bleach-fixer applicable in the method are disclosed. The method comprises a step for developing the light-sensitive material with a color developer, and a step for bleach-fixing the developed light-sensitive material with a bleach-fixer. The light-sensitive material contains at least one silver halide emulsion layer comprising silver halide grains having a silver chloride content of not less than 80 mol %; the bleach-fixer contains a ferric organic acid complex in an amount of not less than 0.2 mol per liter and silver halide fixing agent in an amount of not less than 0.7 mol per liter; and the step for treating with the bleach-fixer is performed for a time of not more than 30 seconds. Bleach-fixing process can be performed stably and rapidly without formation of reticulation and staining on edge portion of the light-sensitive.

15 Claims, No Drawings

METHOD FOR PROCESSING SILVER HALIDE COLOR PHOTOGRAPHIC LIGHT-SENSITIVE MATERIALS AND THE BLEACH-FIXER APPLICABLE THERETO

This application is a continuation of application Ser. No. 385,385, filed Jul. 27, 1989, now abandoned.

FIELD OF THE INVENTION

This invention relates to a method for processing silver halide color photographic light-sensitive materials (hereinafter referred to as light-sensitive materials) and the processing solution applicable thereto and, particularly, to a method for rapidly and stably processing light-sensitive materials and the bleach-fixer applicable thereto.

BACKGROUND OF THE INVENTION

In the field of the art, recently, there have been the demands for the techniques capable of rapidly processing light-sensitive materials and obtaining stable photographic characteristics which are particularly excellent in processing stability and, inter alia, the demands for rapidly processable light-sensitive material developing methods.

To be more concrete, light-sensitive materials have been finished in a continuous process with an automatic processor installed in each photofinishing laboratory. However, as a part of customer-service improvements. Completion of a full series of the services within one day has been demanded, including the acceptance of an photofinishing order, the completion of the photofinishing, and the return of the finished photo articles to customers. Recently, it has urgently been demanded to develop a further rapid processing technique capable of completing the above-mentioned services within only several hours time.

Reviewing the conventional rapid processing techniques for light-sensitive materials, they are roughly classified into the following techniques:

(1) Techniques based on the improvements of light-sensitive materials:

(2) Techniques based on the physical means taken in the course of development processes; and (3) Techniques based on the improvements of solution composition used in development processes.

Among the above techniques, the following have been known.

The techniques of the above classification (1) include, for example, <1> those based on the improvements of silver halide composition, such as a technique of making silver halide finely grained, as disclosed in Japanese Patent Publication Open to Public Inspection (hereinafter referred to as Japanese Patent O.P.I. Publication) No. 51-77223(1976), and a technique of lowering silver bromide content of silver halide as disclosed in Japanese Patent O.P.I. Publication No. 56-18939(1981); <2> Those on the application of additives, such as a technique of adding 1-aryl-3-pyrazolidone having a specific structure into a light-sensitive material, as disclosed in Japanese Patent O.P.I. Publication No. 56-64339(1981), and the techniques of adding I-aryl pyrazolidone, as disclosed in Japanese Patent O.P.I. Publication Nos. 57-144547(1982), 58-50534(1983), 58-50535(1983) and 58-58-50536(1983); <3> those based on the application of a high-rate reactive coupler, Such as the techniques of using high-rate reactive yellow couplers, as disclosed in Japanese Patent Examined Publication No. 51-10783(1976), and Japanese Patent O.P.I. Publication Nos. 50-123342(1975) and 51-102636(1976); <4> those of thinning a photographic component layer, such as disclosed in Japanese Patent Application No. 60-204992(1985); and so forth.

The techniques of the above classification (2) include, for example, those of stirring a processing solution, such as that disclosed in Japanese Patent O.P.I. Publication No. 62-180369(1987), that of raising a temperature of a processing solution as disclosed in Japanese Patent O.P.I. Publication No. 62-22-2255(1987), and so forth.

The techniques of the above classification (3) include, for example, <1> those of using a development accelerator: <2> those of concentrating a color developing agent; <3> those of lowering the concentration of halide ions and, particularly, bromide ions; and so forth.

Among the above techniques and particularly those of Classification (1), the techniques of using a high content of silver chloride, such as disclosed in Japanese Patent O.P.I. Publication Nos. 58-95345(1983), 60-19140(1985), and 58-95736(1983), may be able to give a particularly excellent rapid-processability. For example, Eastman Kodak Company has put Ektacolor 2001 Paper and Konica Corporation has done Konica Color QA Paper each to practical application.

The present inventors have studied more rapid processing techniques by making use of principally silver chloride-containing emulsions endowed particularly with excellent rapid processability. Consequently, they have found some obstacles to achievement of rapid processing in bleach-fixing process and that color developments can be made more rapid when using a high silver chloride-containing emulsion and the above-mentioned rapid processing technique in combination. For example, the techniques of raising a temperature of a bleach-fixer has the problems that the bleach-fixer may hardly be handled because a high temperature processing cannot be avoided, or the so-called sulfuration, formation of free sulfur or sulfide. is liable to occur because the preservability of the bleach-fixer is so seriously lowered that the bleach-fixer loses its commercial value absolutely. It has also been found that a further problem, namely, reticulation, is liable to arise.

Besides the above, the techniques of increasing the concentrations of a bleacher and/or a fixer have also been known. In these techniques, a rapid processability may be achieved to some extent though, it has been found that these techniques have their limits to rapid processing functions when using the conventional silver chlorobromide emulsions which are principally silver bromide-containing emulsions. Therefore, bleaching and/or fixing functions are rather hindered from displaying and a problem of edge stain is raised.

There is a known technique of adding halogen ions as one of the other rapid processing techniques using bleach-fixers. It has been proved from the studies of the present inventors that this particular technique also has problems. For example, the halogen ions are seemingly liable to produce stains on processing apparatus, or that this technique is not so suitable for rapidly processing light-sensitive materials, particularly those principally silver chloride containing a emulsion, because a good effect may be expected unless a large amount of the halogen ions is added.

As described above, it has been very difficult in the field of the art to achieve a rapid bleach-fixing processing, as well as to achieve both of a stable bleach-fixer and the stable processing method using the bleach-fixer.

Taking the above-mentioned facts and problems into consideration, the present inventors have studied the rapid processing functions of bleach-fixers. As a result, they have discovered that the above-mentioned problems can be diminished when using a light-sensitive material comprising an emulsion highly containing silver chloride, while, in the conventional light-sensitive materials each highly containing silver bromide, the bleach-fixing function is rather lowered in a rapid processing and, particularly, in a processing carried out within 30 seconds or shorter, even if increasing the concentrations of the bleacher and/or fixer of a bleach-fixer. The present inventors have also found that the above-mentioned edge-stains produced by increasing the concentrations of the bleacher and/or fixer can be reduced by making a bleach-fixing time shorter and that, in the case of a highly silver chloride-containing emulsions, the desilvering function can be accelerated when a chloride concentrated to a certain level is present. These discoveries led the inventors to make this invention.

It may be considered from the above-mentioned facts that, in the case of using the conventional highly silver bromide-containing emulsions, a rapid processability may be achieved by increasing the concentration of a bleacher and/or fixer to a certain point of time because the rate of the bleaching and/or fixing are determined by diffusion rate of the bleaching and/or fixing agent. However, after that, the rate of bleaching and/or fixing are determined by reaction rate, therefore, the bleach-fixing property has its limit. Contrary, to this, in the case of using silver chloride emulsions, the reaction rate is not more bleaching and/or fixing rate thereof are not more determined by diffusion rate than in a highly silver bromide-containing emulsion, but almost determined by the diffusion rate.

Further, concerning the edge-stains, a reflection type light-sensitive material using a paper support, such as a color paper, is liable to the edge-stains more than those for photographing use. In addition, the edge-stains are liable to be deteriorated when using a highly concentrated bleacher and/or fixer. It has been beyond the expectations for the inventors that such edge-stains can be diminished because a processing time may be shortened by making use of a highly silver chloride-containing emulsion and that the desilvering function may be accelerated by making present a chloride concentrated to a certain level.

SUMMARY OF THE INVENTION

It is, accordingly, an object of the invention to provide: (1) a processing method in which a rapid and stable bleach-fixing can be performed and a processing stability can also excellently be displayed, and (2) a processing solution applicable to the processing method.

Another object of the invention is to provide a method for processing silver halide color photographic light-sensitive materials whereby neither edge-stains nor reticulation can be produced and a bleach-fixer applicable to the light-sensitive materials.

The above-mentioned objects of the invention have been achieved with a method for processing a silver halide color photographic light-sensitive material, comprising a step for developing the light-sensitive material with a color developer, and a step for bleach fixing the developed light-sensitive material with a bleach-fixer, wherein the light-sensitive material contains at least one silver halide emulsion layer comprising silver halide grains having a silver chloride content of not less than 80 mol %; the bleach-fixer contains a ferric organic acid complex salt in an amount of not less than 0.2 mol per liter and a silver halide fixing agent in an amount of not less than 0.7 mol per liter of the bleach-fixer: and the step for bleach-fixing is performed for a time of not more than 30 seconds, and the above-mentioned bleach-fixer.

DETAILED DESCRIPTION OF THE INVENTION

The organic acids applicable to the invention, capable of producing ferric organic acid complex salts preferably include, for example, aminocarboxylic acid series compounds which are amino compounds each having at least one carboxylic acid group, and aminophosphonic acid series compounds which are amino compounds each having at least one phosphoric acid group and, more preferably, the compounds represented by the following Formulas 1 and 2.

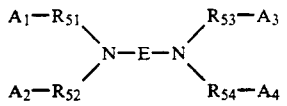

Formula 1

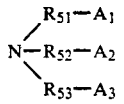

Formula 2

In the formulas, E represents a substituted or unsubstituted alkylene, cycloalkylene, or phenylene group, $—R_{55}OR_{55}OR_{55}—$, or $—R_{55}ZR_{55}—$ in which Z represents $<N—R_{55}—A_5$, or $<N—A_5$; and $A_1$ through $A_5$ represent each a hydrogen atom, —OH, —COOM, or $—PO_3M_2$, in which M represents a hydrogen atom, or an alkali metal atom.

Next, the preferable compounds of the compounds represented by Formulas 1 and 2 will be typically exemplified below.

Exemplified Compounds

| Exemplified Compounds | |
|---|---|
| 1-1 | Ethylenediaminetetraacetic acid, |
| 1-2 | Diethylenetriaminepentaacetic acid, |
| 1-3 | Ethylenediamine-N-(β-hydroxyethyl)-N,N',N,-triacetic acid, |
| 1-4 | 1,3-propylenediaminetetraacetic acid, |
| 1-5 | Triethylenetetraminehexaacetic acid, |
| 1-6 | Cyclohexanediaminetetraacetic acid, |
| 1-7 | 1,2-Diaminopropanetetraacetic acid, |
| 1-8 | 1,3-diaminopropane-2-ol-2-tetraacetic acid, |
| 1-9 | Ethyletherdiaminetetraacetic acid, |
| 1-10 | Glycoletherdiaminetetraacetic acid, |
| 1-11 | Ethylenediaminetetrapropionic acid, |
| 1-12 | Phenylenediaminetetraacetic acid, |
| 1-13 | Disodium ethylenediaminetetraacetate, |
| 1-14 | Tetratrimethylammonium ethylenediaminetetraacetate, |
| 1-15 | Tetrasodium ethylenediaminetetraacetate, |
| 1-16 | Pentasodium diethylenetriaminepentaacetate. |
| 1-17 | Sodium ethylenediamine-N-(β-hydroxyethyl)-N,N',N'-triacetate. |
| 1-18 | Sodium propylenediaminetetraacetate. |
| 1-19 | Ethylenediaminetetramethylenephosphonic acid. |
| 1-20 | Sodium cyclohexanediaminetetraacetate. |
| 1-21 | Diethylenetriaminepentamethylenephosphonic acid. |
| 1-22 | Cyclohexanediaminetetramethylenephosphonic acid. |

-continued

| Exemplified Compounds | |
|---|---|
| 2-1 | Nitrilotriacetic acid. |
| 2-2 | Iminodacetic acid. |
| 2-3 | Hydroxyethyliminodiacetic acid. |
| 2-4 | Nitrilotripropionic acid. |
| 2-5 | Nitrilotrimethylenephosphonic acid. |
| 2-6 | Iminodimethylenephosphonic acid. |
| 2-7 | Hydroxyethyliminodimethylenephosphonic acid. and |
| 2-8 | Trisodium nitrilotriacetate |

Among the above-given aminocarboxylic acid type compounds and aminophosphonic acid type compounds, the particularly preferable compounds from the viewpoint of the effects satisfying the objects of the invention include, for example, 1-1, 1-2, 1-4, 1-5, 1-6, 1-7, 1-8, 1-10, 1-19, 2-1, 2-3 and 2-5.

Among the above-given aminocarboxylic acid compounds and aminophosphinic acid compounds, 1-1,1-2,1-4 and 1-8 are particularly preferable from the viewpoints that the bleaching property should be excellent and the reticulation is to be seldom produced.

The ferric organic acid complex salts relating to the invention may be used in the forms of free acids: alkali metal salts such as sodium salts, potassium salts, lithium salts; ammonium salts: water-soluble amine salts such as triethanolamine salts; and so forth. Among them, potassium salts, sodium salts, and ammonium salts are preferably used. At least one kind of such ferric complex salt may be good enough to be used, but two or more kinds thereof may also be used.

As for ferric complex salts, it is permissible to use at least one kind of ready-made complex salts, or to use ferric ion complex salts prepared by reacting an iron (III) salt such as ferric sulfate, ferric chloride, ferric nitrate, ferric ammonium sulfate, ferric phosphate, or the like with an organic acid such as aminopolycarboxylic acid, aminopolyphosphoric acid, phosphonocarboxylic acid, or the like, in a solution. In the case of producing a complex salts in the solution, Two or more kinds each of one or both of the ferric salts and organic acids may be used in combination. In the cases of using such ready-made complex salts or producing such complex salts either, the organic acids may be used in an amount exceeding a stoichiometric amount. In these cases, the other metal ions than that of iron, such as those of cobalt, copper, and so forth, the complex salts of these metals, or hydrogen peroxide may also be contained.

The ferric organic acid complex salts of the invention may be added in an amount of not less than 0.2 mol per liter of a bleach-fixer used, preferably 0.25 to 1.0 mol per liter thereof and, particularly 0.3 to 0.8 mol per liter thereof.

The bleaching property can greatly be improved by concentrating such ferric organic acid complex salts as specified above and, in addition, the combined use of the principally silver chloride-containing emulsion achieved a rapid processability which was not expected from the conventional types of highly silver bromide-containing silver chlorobromide emulsions.

The fixing agents for silver halides which may be applied to the invention include, for example, (I) halides typified by iodides, (2) thiocyanates, (3) thiosulfates, (4) thiourea, (5) thioether, and so forth. Such halides include, for example, chlorides, bromides, and iodides. Iodides are excellent fixing agents.

Such iodides applicable to the invention include, for example, sodium iodide, lithium iodide, potassium iodide, ammonium iodide, and so forth. Such thiocyanates include, for example, sodium thiocyanate, potassium thiocyanate, ammonium thiocyanate, and so forth. Besides the above, it is also allowed to use any type of soluble thiocyanates regardless of the inorganic, organic, or other salts. Particularly desirable iodides from the point of efficiency include, for example, the ammonium salts having a high rate of diffusion into the gelatin layers of a light-sensitive material subject to processing. However, the most preferable fixing agent applicable to the invention are of thiosufates including, for example, ammonium thiosulfate, sodium thiosulfate, and potassium thiosulfate and, particularly, ammonium thiosulfate, because of their rapid processability, reticulation resistance and edge-stain resistance.

Such fixing agents should be added in an amount of not less than 0.7 mol per liter of the bleach-fixer of the invention, preferably. 0.7 to 4.0 mol per liter and, particularly, 0.8 to 3.0 mol per liter.

If the fixing agent is added in an amount of less than 0.7 mol per liter, a problem is raised in rapid processability. If the amount is larger than 4.0 mol per liter, the fixability is seriously lowered.

In the embodiments of the invention, it is preferable that the bleach-fixer of the invention is to contain a chloride having a concentration of not less than $2\times10^{-2}$ mol per liter of the bleach-fixer, because that of an acceleration of the desilvering reaction, which is considered to be a peculiar function of highly silver chloride-containing emulsions, but not from the conventional types of highly silver bromide containing emulsions.

The chlorides applicable to the invention include, for example, lithium chloride, sodium chloride, potassium chloride, ammonium chloride, and so forth.

The concentration of such chlorides is within the range of, preferably, not less than $3\times10^{-2}$ mol to 2 mol per liter of a bleach-fixer used and, more preferably, not less than $4\times10^{-2}$ mol to 1.0 mol. When the concentration is within the above range, a satisfactory desilvering function can effectively be displayed.

Such chlorides may be added in advance into a bleach-fixer or in the course of processing a light-sensitive material. In short, it is good enough to make such chlorides present in a bleach-fixer so as to have the concentration of the invention.

In the invention, the bleach-fixing step is required to be carried out within 30 seconds. The higher a temperature is, the more a reticulation and an edge-stain are liable to occur. It was found that a reticulation and an edge-stain are liable to occur in such a processing of a light-sensitive material as is carried out at a temperature exceeding 40° C. and, the reticulation is, in particular, liable to occur at a temperature of not lower than 45° C. The inventors have devoted themselves to studying to solve the above-mentioned problems while satisfying the rapid processability. Resultingly, they have discovered the facts that, when a bleach-fixing step is carried out within 30 seconds, the reticulation and edge-stains can peculiarly be improved even if the processing is carried out at a high temperature of, for example, not lower than 40° C. and that the above-mentioned problems can be solved even if the bleach-fixer used therein contains a bleacher and a fixer both highly concentrated.

The processing time of the bleach-fixing step of the invention is, preferably, within the range of 3 to 30 seconds and, more preferably, within the range of 2 to 25 seconds, most preferably within the range of 3 to 20 seconds so that the above-mentioned problems are not only improved remarkably but also improved further remarkably when chlorides are present.

The bleach-fixers of the invention may be added with a variety of bleach-accelerators such as those described in, for example, Japanese Patent O.P.I. Publication No. 46-280(1971), Japanese Patent Examined Publication Nos. 45-8506(1970) and 46-556(1971), Belgian Patent No. 770910, Japanese Patent Examined Publication Nos. 45-8836(1970) and 53-9854(1978), and Japanese Patent O.P.I. Publication Nos. 54-71634(1979) and 49-42349(1974).

The bleach-fixers are allowed to contain a variety of pH buffers such as boric acid, borax, sodium hydroxide, potassium hydroxide, sodium carbonate, potassium carbonate, sodium bicarbonate, potassium bicarbonate, acetic acid, sodium acetate, ammonium hydroxide, and so forth, independently or in combination. Also, the bleach-fixers are allowed to contain a variety of fluorescent brightening agents, defoaming agents or surfactants. Further, the bleach-fixers are allowed to suitably contain preservatives including, for example, hydroxylamine, hydradine, the hydrogen sulfite adducts of an aldehyde compound such as the hydrogensulfite adducts of formaldehyde: organic chelating agents such as aminopolycarboxylic acid: stabilizers such as nitroalcohol, nitric acid salts: organic solvents such as methanol, dimethylsulfoamide, dimethylsulfoxide.

From the viewpoints of storage stability and bleaching efficiency, the bleach-fixers are used at a pH value within the range of, usually, not lower than 4.0 to not higher than 9.5, desirably, not lower than 4.5 to not higher than 8.5 and, most preferably, not lower than 5.0 to not higher than 8.0.

The processing temperature of the bleach-fixer is adjusted to be not higher than 90° C., preferably, within the range of not lower than 30° C. to not higher than 80° C. and, more preferably, not lower than 35° C. to not higher than 70° C. From the viewpoint of rapid processability. A higher temperature is preferably selected and, on the other hand, from the viewpoints of avoiding reticulation resistance and edge-stain resistance, a lower temperature is preferably selected. In the invention, notwithstanding the above-mentioned paradox, the rapid processability can be achieved even if raising a processing temperature, because reticulation and edge-stain can hardly be produced in the invention even if a processing temperature is raised up to not lower than 45° C.

In the invention, a color development is carried out at a temperature within the range of, usually, 20° C. to 90° C. and, preferably, 30° C. to 80° C.

In the development process, a color developer is used at a pH value of, usually, not lower than 8 and, preferably, within the range of not lower than 9.5 to not higher than 12.0.

Such developing process can be made in the presence of a pH buffer, a development inhibitor, an antifoggant, a chelating agent for softening water, a preservative, a development accelerator, a competing coupler, a foggant, a compound for auxiliary developing agent, and a compensator. For further details, refer to Research Disclosure, 17544, Dec., 1978, Section XXI, published by Industrial Opportinities Ltd., Homewell Hazant, Hampshire, Great Britain: and Ullmans Enzyklopaedie der Technischen Chenie, 4th Ed., 18 Ed., 1979, pp. 451–452 and pp. 463–465. Suitable developer compositions are given in, for example, Grant Jaist, Modern Photographic Processing, John Willey and Sons, 1973, Vols. 1 and 2.

The particularly effective color developing agents applicable to the color developers of the invention include, for example, N,N'-dialkyl-p-phenylenediamine type compounds, and their alkyl and phenyl groups may be substituted by any desired substituents. Among these compounds, particularly useful compounds include, for example, N,N'-diethyl-p-phenylenediamine hydrochloride. N-methyl-p-phenylenediamine hydrochloride, N,N'-dimethyl-p-phenylenediamine hydrochloride, 2-amino-5-(N-ethyl-N-dodecyl-N-dodecylamino)-toluene sulfate, N-ethyl-N-β-methanesulfonamidoethyl-3-methyl-4-aminoaniline sulfate. N-ethyl-N-β-hydroxyethyl-3-methyl-4-aminoaniline sulfate, 4-amino-3-methyl-N,N'-diethylaniline sulfate, 4-amino-N-(2-methoxyethyl)-N-ethyl-3-methylaniline-p-toluene sulfonate. Besides the above, other suitable color developing agents are disclosed in, for example, Journal of American Chemical Society. 73, 3100, (1951), Further, the substances constituting a black-and-white developing agent may also be added therein.

In one of the preferable embodiments, the color developer applicable thereto contains Color developing agent A having the following formula:

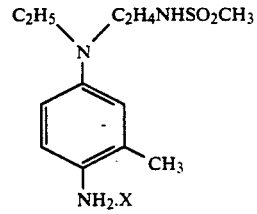

wherein X represents sulfuric acid, hydrochloric acid, p-toluenesulfonic acid, phosphoric acid, or nitric acid, or triethanolamine.

In general, when using color developing agent A in a color developer, it intermingles into a bleach-fixer in the course of continuous processing steps and its bleach-fixability is lowered relatively more than the other color developing agents do. This tendency is remarkably increased particularly in the case of using an emulsion highly containing silver chloride or in the case of using the developing agent in a high concentration. There problems can be avoided however, by applying the invention.

The above-mentioned color developing agent is used preferably in an amount within the range of $5\times10^{-3}$ to $2\times10^{-1}$ mol per liter of a color developer used. From the viewpoint of a rapid processability, it is used more preferably in an amount within the range of $1.0\times10^{-2}$ to $2\times10^{-1}$ mol per liter of the color developer used.

Such color developing agent may be used independently or in combination, and they may be used in combination with black-and-white color developing agent such as phenidone, 4-hydroxymethyl-4-methyl-1-phenyl-3-pyrazolidone, Metol, and so forth.

The color developers of the invention may preferably be applied with organic preservatives including, for example, hydroxylamine derivatives such as those described in Japanese Patent O.P.I. Publication Nos 63-146043(1988), 63-146042(1988), 63-146041(1988), 63-146040(1988), 63-135938(1988) and 63-118748(1988);

and hydroxamic acids, hydrazines, hydrazides, phenols, α-hydroxyketones, α-aminoketones, saccharides, monoamines, diamines, quaternary ammonium salts, nitroxyl radicals, alcohols, oximes, diazide compounds, condensed ring type amines, and so forth each described in Japanese Patent O.P.I. Publication No. 64-62639(1989). In the meanwhile, when a compound represented by the following Formula B-I is added into a color developer, the solution stability and desilvering property of a bleach-fixer can be improved in the course of continuous processing and, in addition, a reticulation is also improved, though the reason thereof is not clear. Further in this case, a separate effect to inhibit the crystal deposition on the liquid level of a color developer tank can be displayed. Therefore, the embodiment is given as one of the more preferable embodiments of the invention.

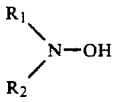

Formula B-I wherein $R_1$ and $R_2$ represent each an alkyl group or a hydrogen atom, provided, both of $R_1$ and $R_2$ shall not be hydrogen atoms at the same time but may also be able to form a ring such as a heterocyclic piperidine or morpholine ring. The alkyl groups represented by $R_1$ and $R_2$ may be the same as or different from each other and, among them, analkyl group having 1 to 3 carbon atoms is preferable. Such alkyl groups include those having a substituent.

The typical examples of the hydroxylamine type compounds represented by Formula B-I are described in U.S. Pat. Nos. 3,287,125, 3,293,034, 3,287,124, and so forth. The compounds particularly preferable will be exemplified below.

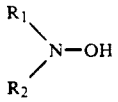

| Exemplified compound | $R_1$ | $R_2$ |
|---|---|---|
| A-1 | $-C_2H_5$ | $-C_2H_5$ |
| A-2 | $-CH_3$ | $-CH_3$ |
| A-3 | $-C_3H_7(n)$ | $-C_3H_7(n)$ |
| A-4 | $-C_3H_7(i)$ | $-C_3H_7(i)$ |
| A-5 | $-CH_3$ | $-C_2H_5$ |
| A-6 | $-C_2H_5$ | $-C_3H_7(i)$ |
| A-7 | $-CH_3$ | $-C_3H_7(i)$ |
| A-8 | $-H$ | $-C_2H_5$ |
| A-9 | $-H$ | $-C_3H_7(n)$ |
| A-10 | $-H$ | $-CH_3$ |
| A-11 | $-H$ | $-C_3H_7(i)$ |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 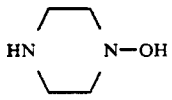 | |
| A-17 | 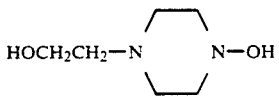 | |

-continued

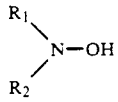

| Exemplified compound | $R_1$ | $R_2$ |
|---|---|---|
| A-18 | 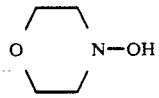 | |
| A-19 | 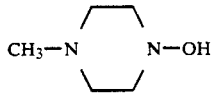 | |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |
| A-32 | 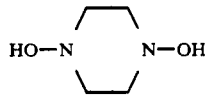 | |

Usually, the above-given compounds are used in the form of a freed amine, hydrochloride, sulfate, p-toluenesulfonte, oxalate, phosphate, acetate, or the like.

In a color developer, the compounds of the invention represented by Formula B-I are used in a concentration within the range of, usually, 0.2 to 50 g, preferably, 0.5 to 30 g and, more preferably, 1 to 15 g each per liter.

The compounds represented by Formula B-I may also be used with conventional hydroxylamine and the aforegiven organic preservative in combination. From the viewpoint of developability, however, it is preferred not to use hydroxylamine.

The color developer relating to the invention is preferably contains a compound represented by the following Formula D, because such a compound can be effective to improve the air oxidation of the color developer and can scarcely affect a bleach-fixer even if the compound is mixed into the bleach-fixer.

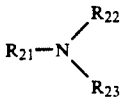

Formula D wherein $R_{21}$ represents a hydroxyalkyl group having 2 to 6 carbon atoms; and $R_{22}$ and $R_{23}$ represent each a hydrogen atom, an alkyl group having 1 to 6 carbon atoms, a benzyl group, or a group represented by

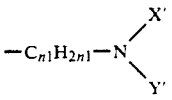

in which $n_1$ is an integer of 1 to 6, and X' and Y' represent each a hydrogen atom, an alkyl group having 1 to 6 carbon atoms, or a hydroxyalkyl group having 2 to 6 carbon atoms.

The preferable examples of the compounds represented by Formula D will be given below.

| | |
|---|---|
| D-1 | Ethanolamine, |
| D-2 | Diethanolamine, |
| D-3 | Triethanolamine, |
| D-4 | Di-isopropanolamine, |
| D-5 | 2-methylaminoethanol, |
| D-6 | 2-ethylaminoethanol, |
| D-7 | 2-dimethylaminoethanol, |
| D-8 | 2-diethylaminoethanol, |
| D-9 | 1-diethylamino-2-propanol, |
| D-10 | 3-diethylamino-1-propanol, |
| D-11 | 3-dimethylamino-1-propanol, |
| D-12 | Isopropylaminoethanol, |
| D-13 | 3-amino-1-propanol, |
| D-14 | 2-amino-2-methyl-1,3-propanediol |
| D-15 | Ethylenediaminetetraisopropanol, |
| D-16 | Benzyldiethanolamine, and |
| D-17 | 2-amino-2-(hydroxymethyl)-1,3-propanediol |

From the viewpoint of air oxidation prevention, the compounds represented by Formula D are used in an amount within the range of, preferably, I to 100 g per liter of a color developer used and, more preferably, 2 to 30 g.

In the color developers applied to the invention, the sulfite concentration thereof should be, preferably, not more than $4\times10^{-3}$ mol per liter of the color developer used and, more preferably, within the range of $2\times10^{-4}$ to zero mol, from the viewpoints of rapid processability and bleach-flexibility. The reason why the above concentration is preferred is that an emulsion highly containing silver chloride is liable to be substantially affected more seriously than in the case of using the conventional types of emulsions highly containing silver bromide, especially when a sulfite-concentration is high in a color developer, so that density of image may sharply be lowered.

The sulfites applicable to the invention include, for example, sodium sulfite, potassium sulfite, sodium bisulfite potassium bisulfite.

In the color developers applied to the invention, it is not preferable to use benzyl alcohol and, in addition, it is preferable to eliminate a hardly soluble organic solvent typified by phenethyl alcohol from using from the viewpoints of effective achievements of the recoloring and desilvering properties of a bleach-fixer used. When using alcohol, tar is apt to form in the course of using a color developer for a long period of time and, particularly, in a continuous treatment being carried out in a low replenishing system. There may further be some instances where the tar may adhere to a light-sensitive paper subject to processing so as to impair the commercial value of the light-sensitive paper.

The hardly soluble organic solvents are poor in solubility to water. Therefore, a stirring means is required to prepare a color developer itself, furthermore a development acceleration effect of the solvent is limited because of the poor solubility of it, of such a stirring means, even when the developer is prepared by the use of the stirring means.

Further, hardly soluble organic solvents have a great load to counter pollutant effects, such as a biochemical oxygen demand, BOD, and so forth, and therefore these solvents cannot be disposed into sewers, rivers, or the like. Removal requires high costs and extensive labor. It is, accordingly, desirable to reduce or eliminate the amounts of not only benzyl alcohol but also other hardly soluble organic solvents.

In addition to the above, the color developers of the invention are also allowed to contain, if required, ethyleneglycol, methylcellosolve, methanol, acetone, dimethylformamide, β-cyclodextrin and, besides, other compounds such as those described in Japanese Patent Examined Publication Nos. 47-33378(1972) and 44-9509(1969), as an organic solvent for enhancing the solubility of a developing agent.

Besides the above, a variety of other additives such as an antistaining agent, an antisludging agent, and an interlayer effect accelerator may be used.

From the viewpoint of obtaining the effect of the objects of the invention, it is preferable to add the following chelating agent to the color developer used in the invention. Namely, diethylenetriaminepentaacetic acid, ethylenediaminetetraacetic acid, nitrilotriacetic acid, ethylenediaminetetramethylenephosphonic acid, and 1-hydroxyethylidene-1,1-diphosphonic acid, and salts of them.

In a color developing process applicable to the invention, the processing time is within 35 seconds and, preferably, within the range of 5 seconds to not longer than 25 seconds.

Now, the stabilizing process applicable in the processing of the invention will be detailed. When a light-sensitive material is processed with adding a replenisher in an amount 1 to 100 times per unit area of the light-sensitive material as much as an amount carried-in from the preceding bath, a remarkable effect can be displayed particularly against the stains in unexposed portions. A preferable embodiment of the stabilizing process will now be detailed.

The compounds preferably applicable to stabilizers include, for example, a chelating agent having a chelating stability constant of not less than 8 to iron ions. These chelating agents may preferably be used from the viewpoint of achieving the objects of the invention.

The term, chelating stability constant, used herein means a constant which is generally known from the literatures such as L. G. Sillen and A. E. Martell, 'Stability Constants of Metal-ion Complexes'. The Chemical Society. London, (1964; S. Chaberek and A. E. Martell, 'Organic Sequestering Agents', Wiley. (1959): and so forth.

The above-mentioned chelating agents having a stability constant of not less than 8 to iron ions, which are preferably applicable to stabilizers, include for example an organic carboxylic acid chelating agent, an organic phosphoric acid chelating agent, an inorganic phosphoric acid chelating agent, a polyhydroxy compound, and so forth. The above-mentioned iron ions herein mean ferric ions, i.e., $Fe^{3+}$.

Typical compounds for the chelating agents having a chelating stability constant of not less than 8 to ferric ion may be exemplified as follows. It is, however, to be understood that there is no special limitation thereto. Namely, ethylenediamineorthohydroxyphenylacetic acid, diaminopropanetetraacetic acid, nitrilotriacetic acid, hydroxyethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycoletherdiaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-diphosphonic acid, sodium pyrophosphate, sodium tetrapolyphosphate, and sodium hexametaphosphate. Among them, organic phosphoric acid chelating agents and inorganic condensed-phosphoric acid chelating agents are particularly preferable and, inter alia. 1-hydroxyethylidene-1,1-diphosphoric acid is most preferable to be used.

The above-given chelating agents may be used in an amount of within the range of, preferably. 0.01 to 100 g per liter of a stabilizer used and, more preferably, 0.05 to 50 g so that the white background whiteness of unexposed areas may remarkably be improved and, further, the preservability of post-processed images may effectively be enhanced.

As for the compounds for adding into the stabilizers, ammonium compounds are given as the particularly preferable compounds.

These compounds may be supplied from the ammonium salts of various kinds of inorganic compounds. They include, for example, ammonium hydroxide, ammonium bromide, ammonium carbonate, ammonium chloride.

These ammonium compounds may be added in an amount or not less than $1.0\times10^{-5}$ mol, more preferably, within the range of 0.001 to 5.0 mol and, further preferably, within the range of 0.002 to 1.0 mol.

It is desired that the stabilizers should contain a sulfite in such an amount that no bacterium should not be developed.

The sulfites to be contained in the stabilizers may be any one of organic or inorganic matters capable of releasing sulfite ion. Among them, inorganic salts are preferable. Such preferable compounds include, for example, sodium sulfite, potassium sulfite, ammonium sulfite, ammonium bisulfite, potassium bisulfite, sodium bisulfite, sodium metabisulfite, potassium metabisulfite, ammonium metabisulfite and hydrosulfite, sodium glutaraldehydebisbisulfite, sodium succinaldehydebisbisulfite, and so forth. The above-given sulfites may be so added into a stabilizer as to be at least in a proportion of $1.0\times10^{-5}$ mol per liter of the stabilizer used and, more preferably, within the range of $5\times10^{-5}$ to $1.0\times10^{-1}$ mol per liter. These sulfites may be added directly into the stabilizer and, more preferably, into a stabilizer replenisher.

The stabilizers applicable to the invention preferably contain an antimold and, whereby prevention of sulfur or sulfide deposition and image storage properties may further be improved.

The antimolds, which may preferably be added in a stabilizer, include, for example, sorbic acid, benzoic acid type compounds, phenol type compounds, thiazole type compounds, pyridine type compounds, guanidine type compounds, carbamate type compounds, triazole type compounds, morpholine type compounds, quaternary phosphonium type compounds, ammonium type compounds, urea type compounds, isoxazole type compounds, propanolamine type compounds, sulfamide type compounds, pyronone type compounds, amino type compounds, hypochlorite type compounds, and compounds capable of releasing these compounds.

To the stabilizers, such antimolds may be added in an amount within the range of, preferably, 0.001 to 30 g per liter of the stabilizer used and, more preferably, 0.003 to 5 g per liter.

The stabilizers applicable to the invention are preferable to use with a chelating agent in combination and to contain a metal salt.

Such metal salts include, for example, those of Ba, Ca, Ce, Co, In, La, Mn, Ni, Bi, Pb, Sn, Zn, Ti, Zr, Mg, Al or Sr. Among them, those of Ni, Bi, Zn, and Zr, which may be supplied in the form of inorganic salts such as a halide, hydrooxide, sulfate, carbonate, phosphate, acetate, or a water-soluble chelating agent. They are used in an amount within the range of $1\times10^{-4}$ to $1\times10^{-1}$ mol per liter of a stabilizer used and, more preferably, $4\times10^{-4}$ to $2\times10^{-2}$ mol. When adding such metal salts, not only the effect of the invention can remarkably be displayed, but also the background whiteness, storage stability, and yellow stain resistance may also effectively be improved.

Besides the above, aldehydes may be added into the stabilizers of the invention.

Such aldehydes may be added in an amount within the range of, preferably, 0.1 to 50 g per liter of the stabilizer used and, more preferably, 0.5 to 10 g.

In the invention, it is also allowed to use a method ni which an ion exchange resin-treated stabilizer is used to contain the aforementioned antimolds and halogen ion releasing compounds.

The pH values of the stabilizers applicable to the invention should preferably be within the range of 5.5 to 10.0. The stabilizers may contain any of pH adjusters such as the generally known alkalinizers or acidifiers.

A stabilizing treatment should be carried out at a temperature within the range of, preferably, 15° to 85° C. and, more preferably, 20° to 75° C.

The shorter the processing time is, the more preferable, from the viewpoint of obtaining the remarkable effect of the invention. The processing time is therefore within the range of, preferably, 2 to 60 seconds and, most preferably, 3 to 40 seconds.

In the stabilizing treatment applicable in the process of the invention, the amount of replenishing a stabilizer should be preferably 0.1 to 50 times and more preferably 0.5 to 30 times as much as an amount of the preceding bath, i.e., a bleach-fixer, carried in per unit area of a light-sensitive material being processed, from the viewpoints of rapid processability and dye-image storage. However, a throwaway batch system is preferable form the viewpoint of making an In the stabilizing treatments, a stabilizing tank system is preferably comprised of 1 to 5 tanks, more preferably. 1 to 3 tanks and, most preferably, a single tank from the viewpoints of displaying desilvering and rapid processing functions.

In the whole processing step of the invention including a color developing step, a bleach-fixing step, a stabilizing step and so forth but a drying step, the whole processing time should be, preferably within 90 seconds, more preferably, within the range of 6 to 75 seconds, further preferably, within the range of 9 to 60 seconds and, most preferably, within the range of 15 to 50 seconds.

Among the processing methods of the invention, a preferable method is to carry out a bleach-fixation of the invention immediately after a color development is completed. It is also allowed to carry out a bleach-fixation of the invention after carrying out a washing, rinsing, stopping, or the like steps upon completion of a color development.

Next, the examples of the typical processing steps will be given. It is however to be understood that the invention shall not be limited thereto.

1. Color developing—bleach-fixing—washing.
2. Color developing—bleach-fixing—washing in a little water—washing.
3. Color developing—bleach-fixing—washing—stabilizing,
4. Color developing—bleach-fixing—stabilizing,
5. Color developing—bleach-fixing—primary stabilizing—secondary stabilizing.
6. Color developing—bleaching—bleach-fixing—washing (or stabilizing),
7. Color developing—fixing—bleach-fixing—washing (or stabilizing).
8. Color developing—bleaching—bleach-fixing—washing—stabilizing,
9. Color developing—bleaching—bleach-fixing—primary stabilizing—secondary stabilizing,
10. Color developing—bleach-fixing—primary stabilizing—secondary stabilizing,
11. Color developing—bleach-fixing—washing—stabilizing.
12. Color developing—washing in a little water—bleach-fixing—washing in a little water—washing—stabilizing.
13. Color developing—stopping—bleach-fixing—washing in a little water—washing—stabilizing, and
14. Color developing—black-and-white developing—washing (or stabilizing)—reversing—color developing—bleach-fixing—washing (or omitted)—stabilizing.

Among the above-given processing steps, the steps 1,2, 3, 4, and 5 may be used more preferably in the invention.

In light-sensitive materials which are to be processed in the invention, at least one silver halide emulsion layer. which comprises silver halide grains having a silver chloride content of not less than 80 mol %, is included. In the embodiments of the invention, it is preferable that the silver halide grains contain silver chloride in an proportion of, at least, 90 mol %. In other words, the grains are comprised substantially of silver chloride and a very small amount of bromides and iodides.

Especially when silver halide grains contain silver chloride in a proportion of not less than 95 mol %, the objects of the invention can effectively be achieved. In particular, the desilvering function can excellently be improved when a highly silver chloride-containing emulsion is used, and those silver chloride grains are preferably used from the viewpoint of performing a rapid processing. In this case, it is particularly preferable that the proportion of the silver chloride is not less than 98 mol %. In the special cases, besides the above, one of the embodiments of the invention is that a blue-sensitive layer comprises a silver halide containing bromides in a proportion of about 30 mol % and the other two layers such as a green-sensitive layer and a red-sensitive layer each contain chlorides in a proportion of the order of 99 mol %. Such silver halide grains are those of the core/shell type having a double-layered structure.

In light-sensitive materials which are to be processed in the invention, the silver halide emulsion layers thereof each contain color couplers each for forming a non-diffusible dye upon reaction with the oxidized products of a color developing agent. Advantageously, such couplers are each non-diffusively incorporated into the emulsion layer or a layer closely contacted with the emulsion layer.

As described above, a red-sensitive layer, for example, contains a non-diffusible color coupler which is usually a phenol or α-naphthol type coupler and is capable of forming a cyan color image. A green-sensitive layer, for example, contains at least one non-diffusible color coupler which is usually a 5-pyrazolone type or pyrazolotriazole type color coupler and is capable of forming a magenta color image. A blue-sensitive layer, for example, may contain at least one non-diffusible color coupler which is usually a color coupler having an open-chained ketomethylene group and is capable of forming a yellow color image. Such a color coupler may be 6-, 4-, or 2-equivalent coupler, for example.

In the light-sensitive materials which are to be processed in the invention, a 2-equivalent coupler may preferably be used in particular.

Some of the couplers suitable for the purpose are given in the following publications, for example: W. Pelz, 'Farbkuppler' disclosed in Mitteilungen ausden Forschungslaboratorien der Agfa, Leverkusen, Munchen, Vol. III, p. 111, 1961; K. Venkataraman, 'The Chemistry of Synthetic Dyes', Vol. 4, pp. 341-387, Academic Press; 'The Theory of the Photographic Process'4th Ed., pp. 353-362; and 'Research Disclosure', No. 17643, Section VII.

It is preferred that light-sensitive materials which are to be processed in the method of the invention should be used with the following magenta, cyan and yellow couplers such as those disclosed in Japanese Patent O.P.I. Publication No. 63-106655(1988).

The magenta couplers include those represented by the following Formula M-I.

Formula M-I

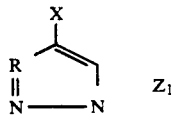

wherein

Z represents a group consisting of non-metal atoms necessary to complete a nitrogen-containing heterocyclic ring, provided, the heterocyclic ring completed by Z may have a substituent;

X represents a hydrogen atom or a group capable of being split off upon reaction with the oxidized product of a color developing agent: and R represents a hydrogen atom or a substituent.

The typical compounds will be exemplified below

1
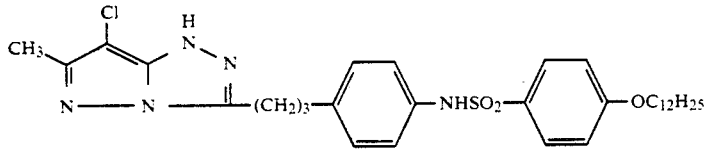
2
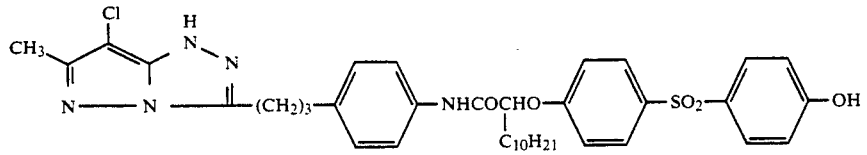
3
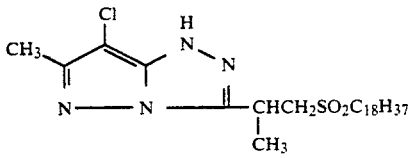
4
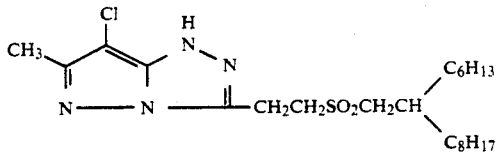
5
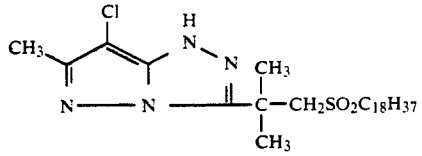
6
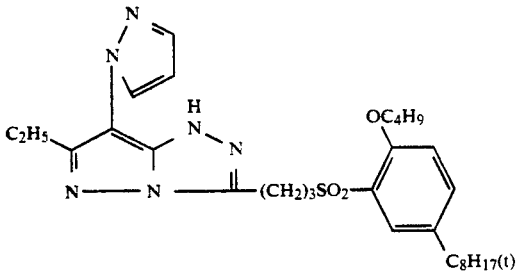
7
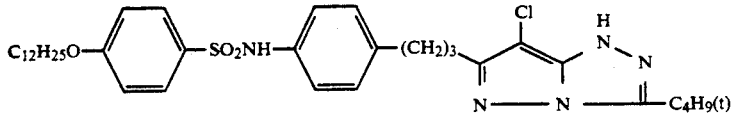
8
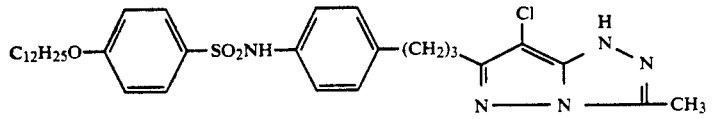
9
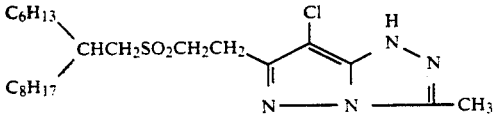

-continued
10
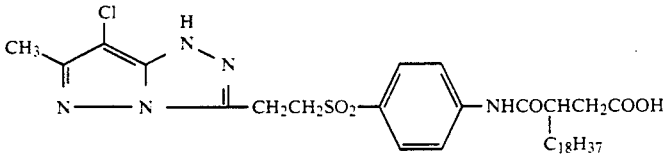
11
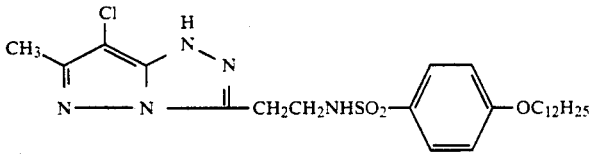
12
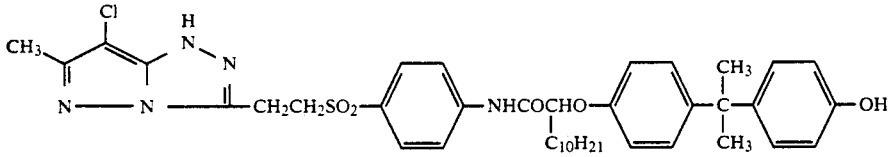
13
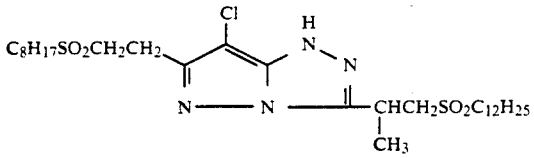
14
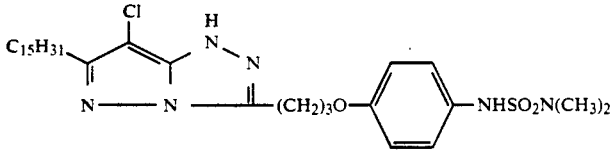
15
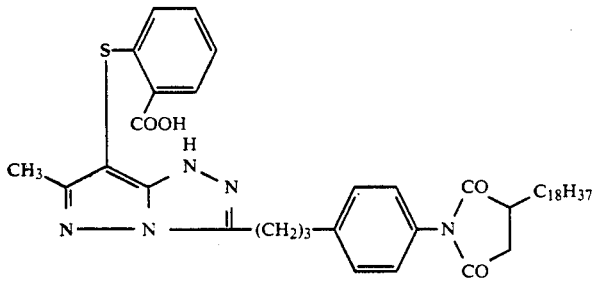
16
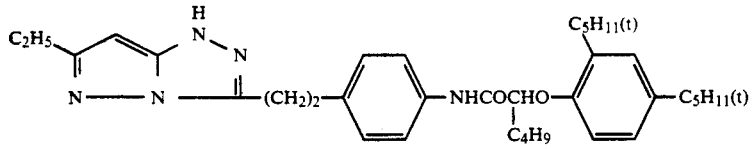
17
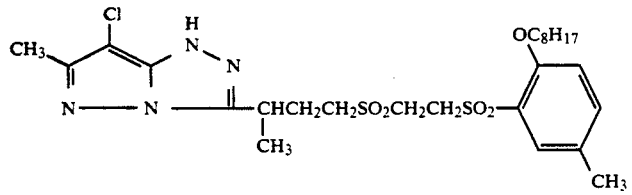
18
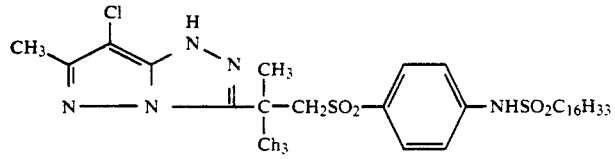

-continued
19
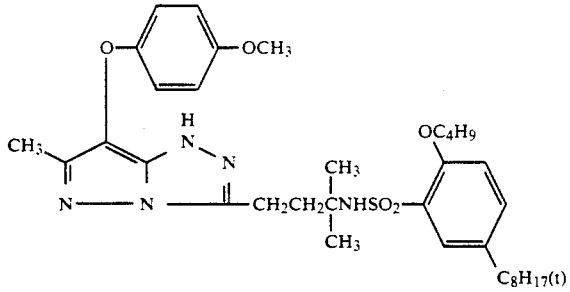
20
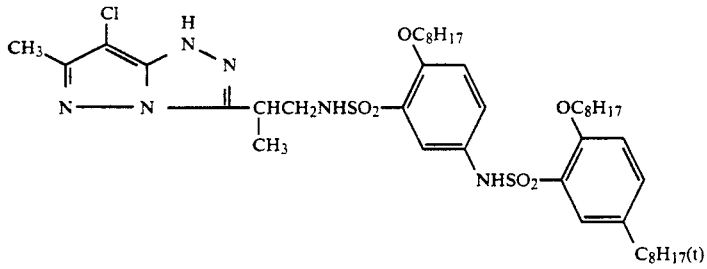
21
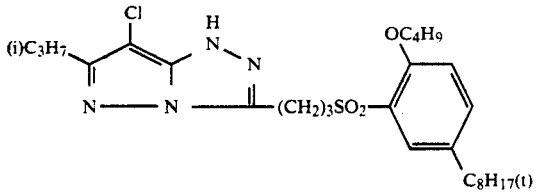
22
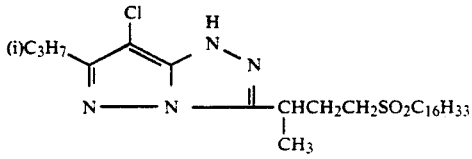
23
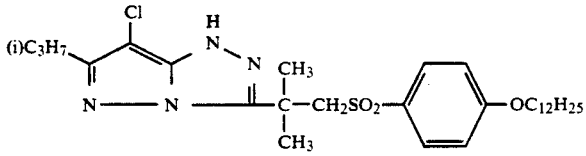
24
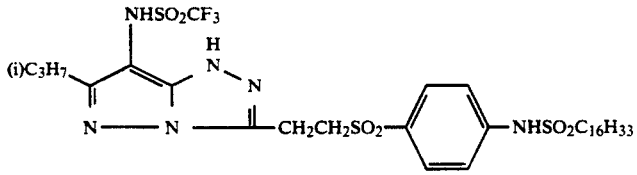
25
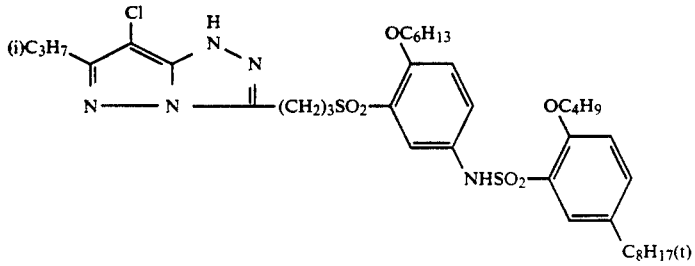

-continued
26
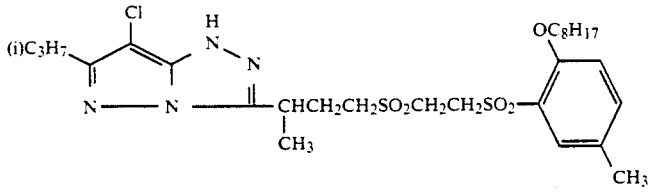
27
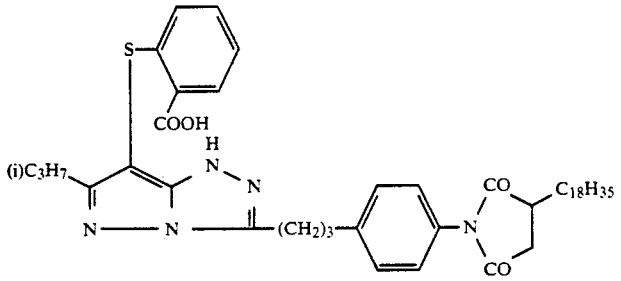
28
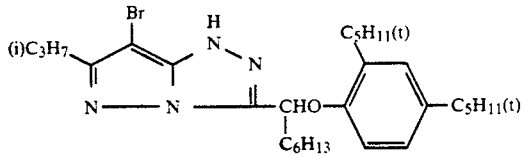
29
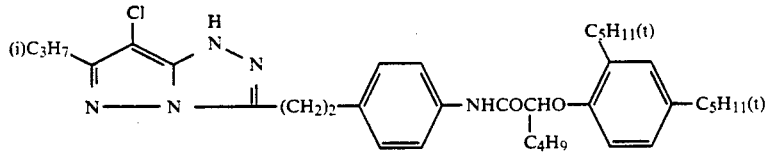
30
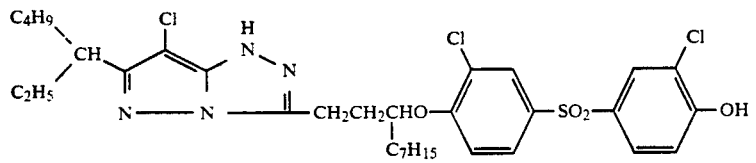
31
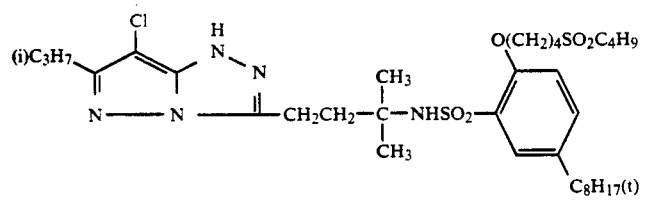
32
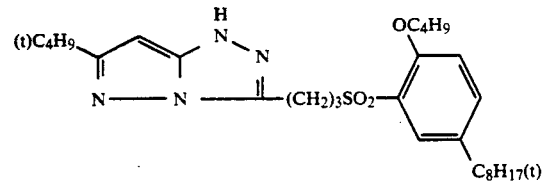
33
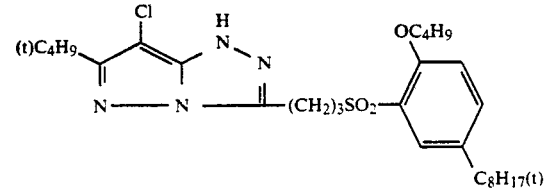

-continued
34
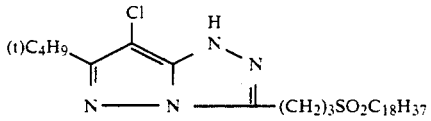
35
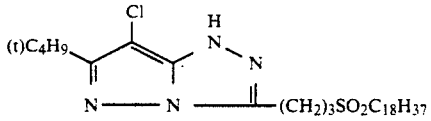
36
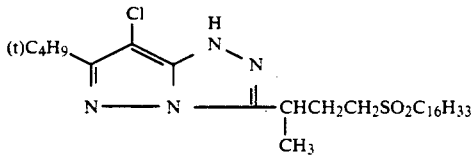
37
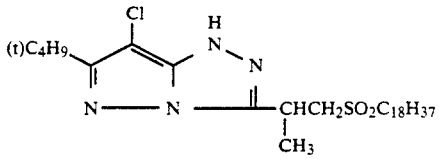
38
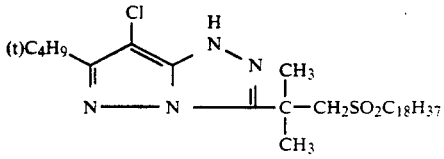
39
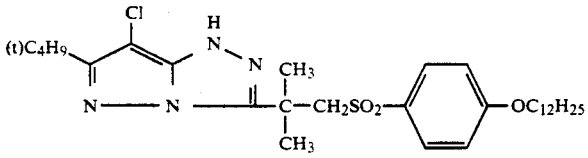
40
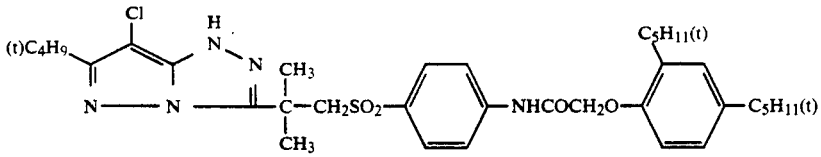
41
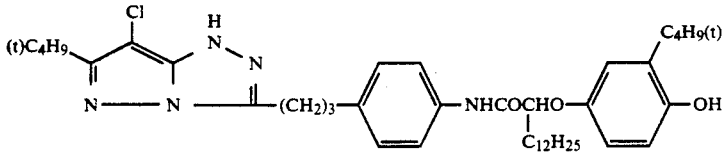
42
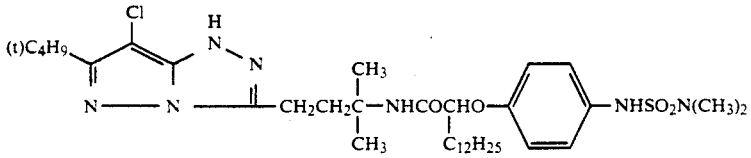

-continued
43
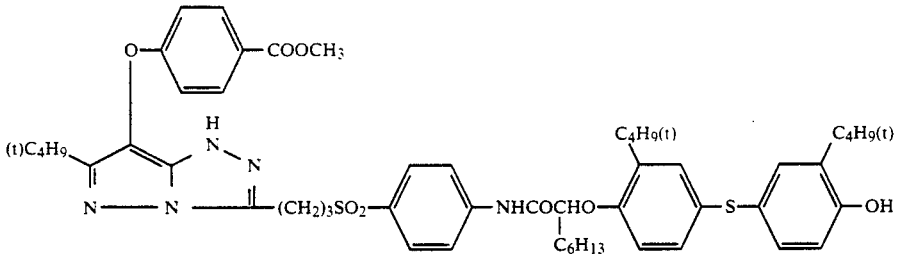
44
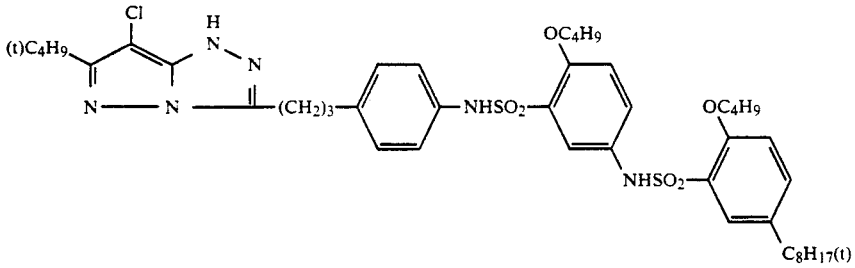
45
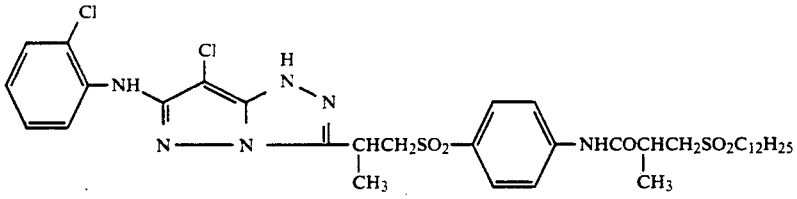
46
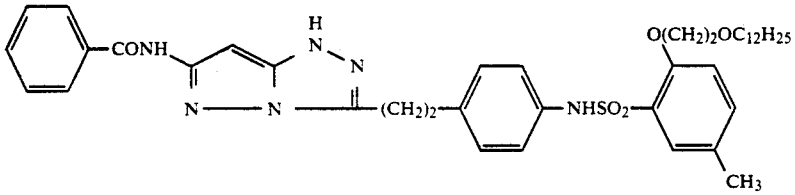
47
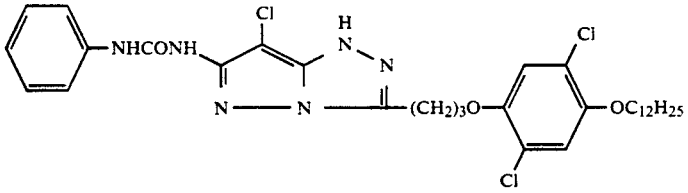
48
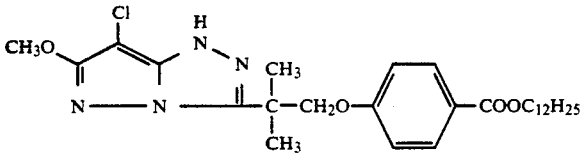
49
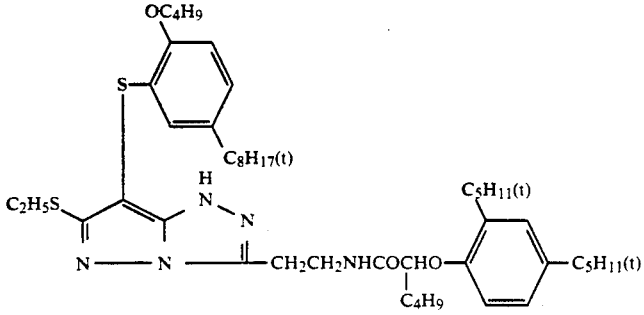

-continued
50
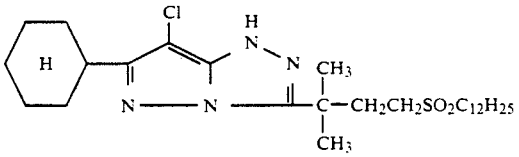
51
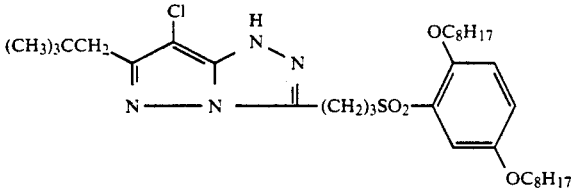
52
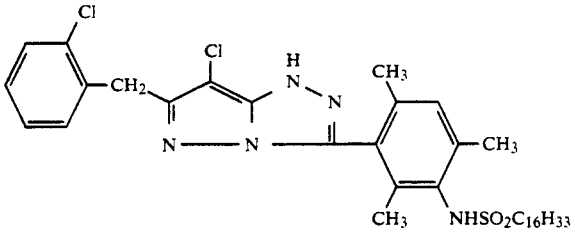
53
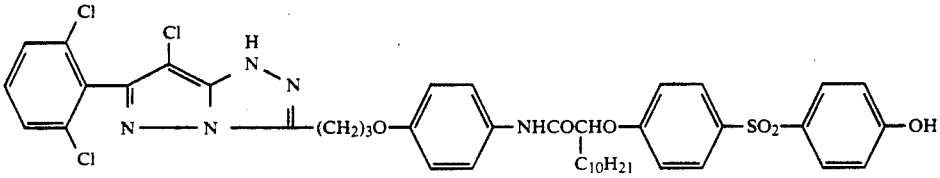
54
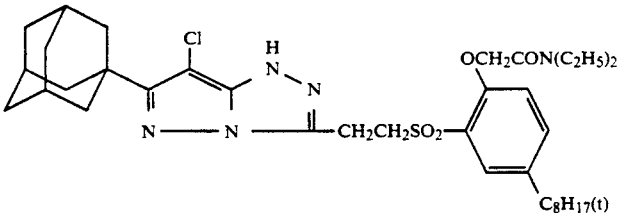
55
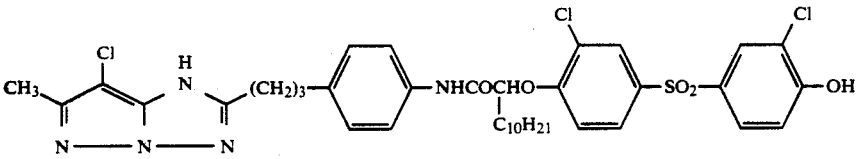
56
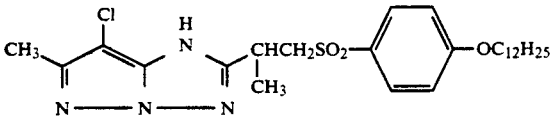
57
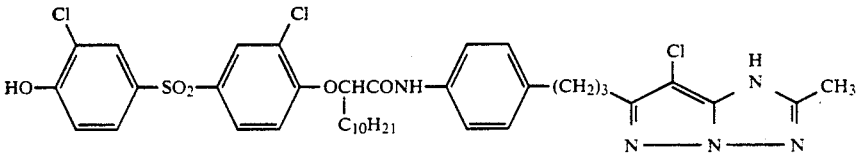

-continued
58
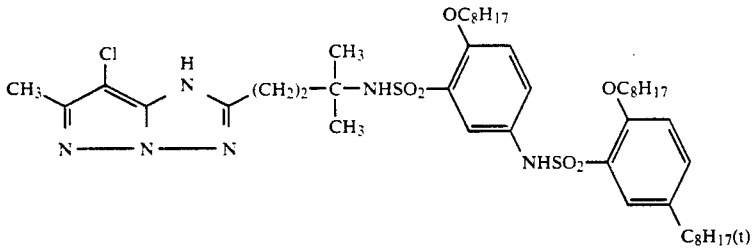
59
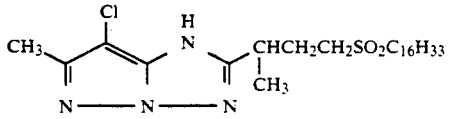
60
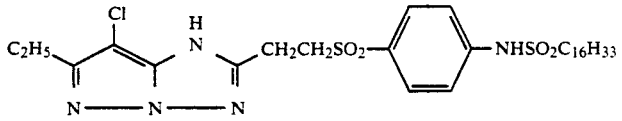
61
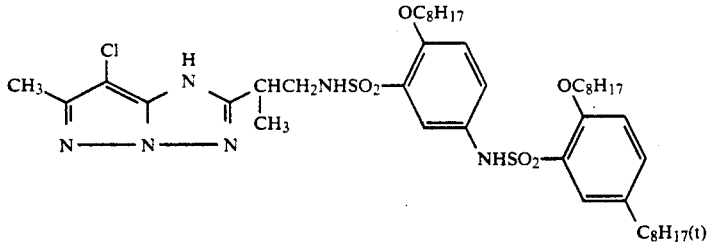
62
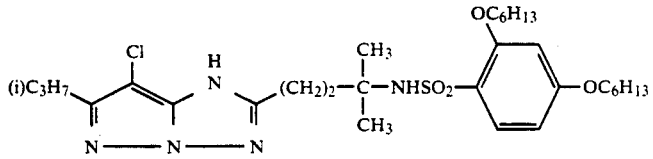
63
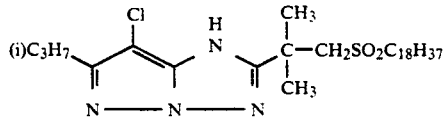
64
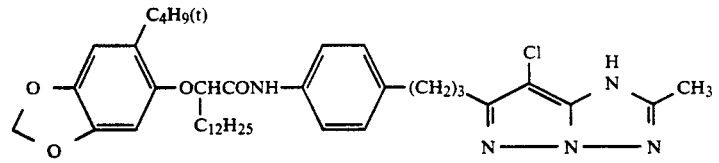
65
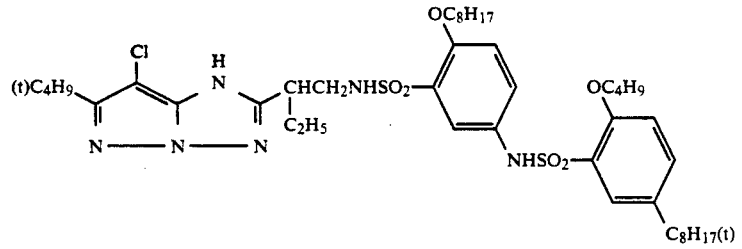
66
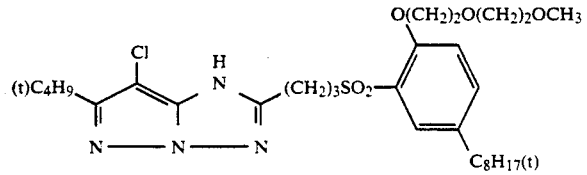

-continued
67
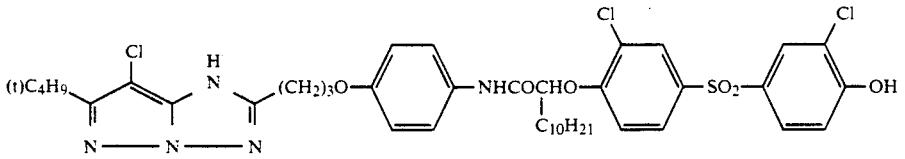
68
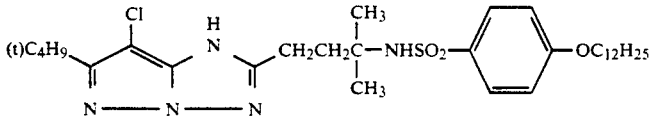
69
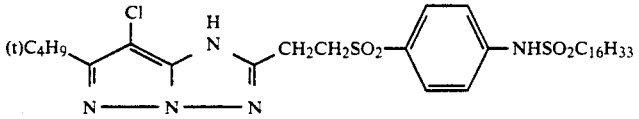
70
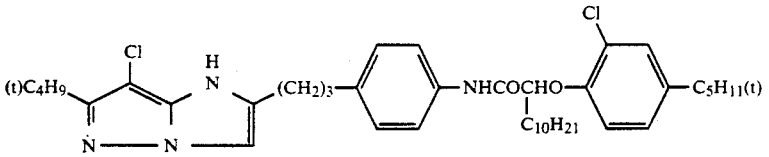
71
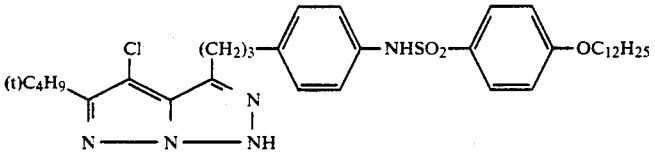
72
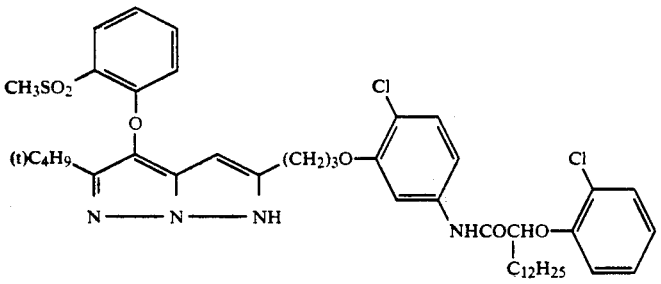
73
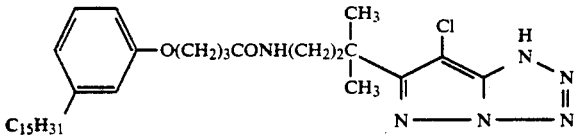
74
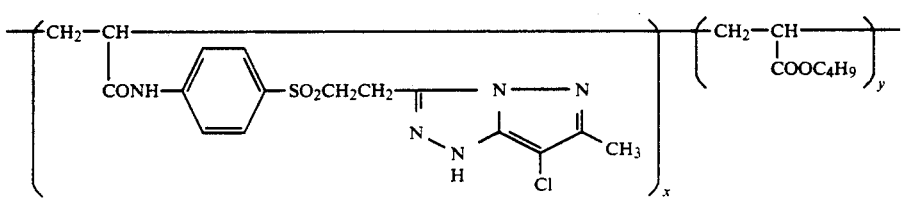
x:y = 50:50

-continued

75

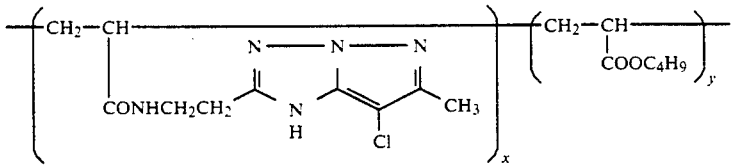

x:y = 50:50

76

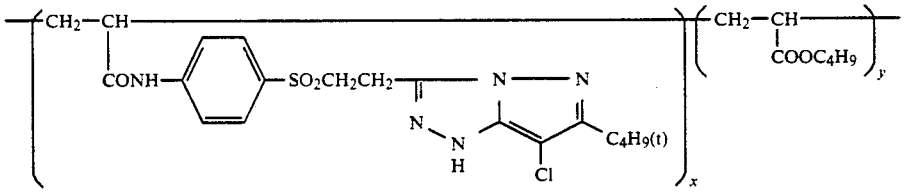

x:y = 50:50

77

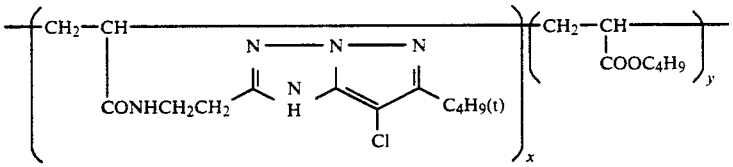

x:y = 50:50

The cyan couplers having the following Formula C-I or C-II should preferably be used in the invention.

Formula C-I

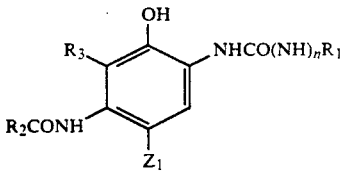

Formula C-II

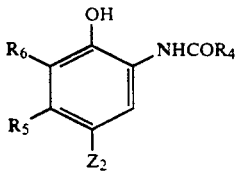

In the above formulas, $R_1$, $R_2$, and $R_4$ represent each an aliphatic group which may have a substituent, an aryl group, or a heterocyclic group; $R_3$ and $R_6$ represent each a hydrogen atom, a halogen atom, an aliphatic group which may have a substituent, an aryl group, or an acylamino group, provided, $R_3$ is allowed to complete a ring together with $R_2$, $R_5$ represents an alkyl group which may have a substituent; $Z_1$ and $Z_2$ represent each a hydrogen atom, or a group capable of being split off upon reaction with the oxidized product of a color developing agent; and n is an integer of 0 or 1.

The cyan couplers represented by Formulas C-I and C-II will be exemplified below.

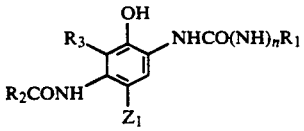

| Exemplified Compound No. | $R_1$ | $R_2$ | $R_3$ | $Z_1$ | n |
|---|---|---|---|---|---|
| C'-1 | $-(CF_2)_4H$ | 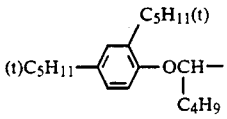 | $-H$ | $-Cl$ | 0 |

-continued
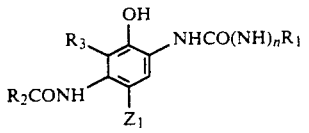
| Exemplified Compound No. | $R_1$ | $R_2$ | $R_3$ | $Z_1$ | n |
|---|---|---|---|---|---|
| C'-2 | 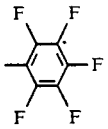 | 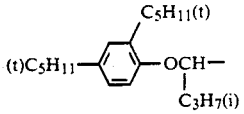 | —H | —Cl | 0 |
| C'-3 | 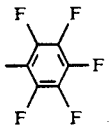 | 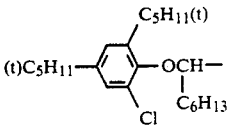 | —H | —Cl | 0 |
| C'-4 | 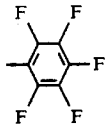 | $C_{16}H_{33}$— | —Cl | —Cl | 0 |
| C'-5 | 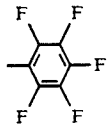 | 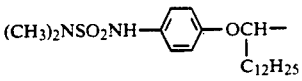 | —H | 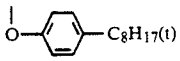 | 0 |
| C'-6 | 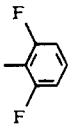 | 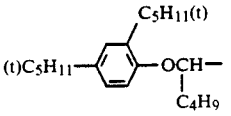 | —H | —H | 0 |
| C'-7 | 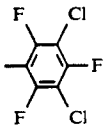 | 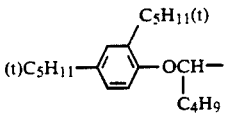 | —H | —Cl | 0 |
| C'-8 | 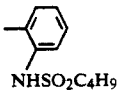 | 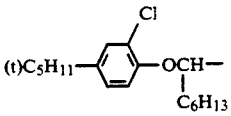 | —H | —Cl | 0 |
| C'-9 | 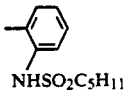 | 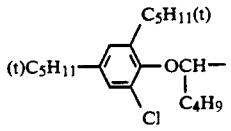 | —H | 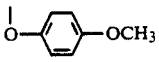 | 0 |
| C'-10 | 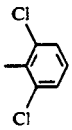 | 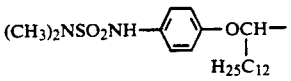 | —H | —Cl | 0 |
| C'-11 | 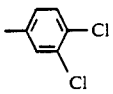 | 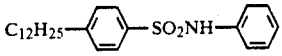 | —H | —Cl | 0 |

-continued
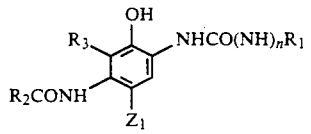
| Exemplified Compound No. | $R_1$ | $R_2$ | $R_3$ | $Z_1$ | n |
|---|---|---|---|---|---|
| C'-12 | 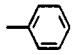 | 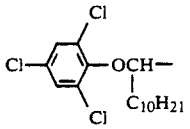 | —H | $-OCH_2CONHC_3H_7$ | 0 |
| C'-13 | 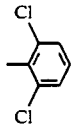 | 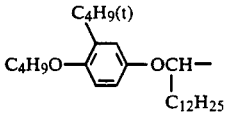 | —H | —Cl | 0 |
| C'-14 | 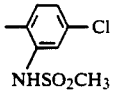 | 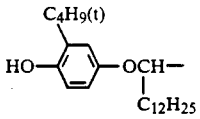 | —H | —Cl | 0 |
| C'-15 | 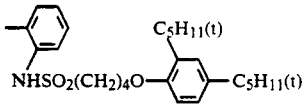 | 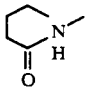 (A ring is formed by $R_3CONH-$ and $R_2-$) | | —Cl | 0 |
| C'-16 | 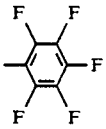 | 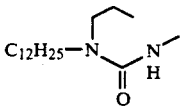 (A ring is formed by $R_3CONH-$ and $R_2-$) | | —Cl | 0 |
| C'-17 | 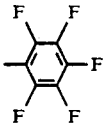 | 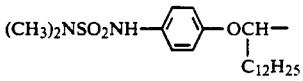 | —H | —Cl | 0 |
| C'-18 | 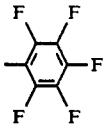 | 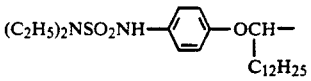 | —H | —Cl | 0 |
| C'-19 | 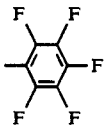 | 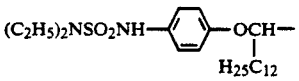 | —H | 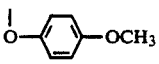 | 0 |
| C'-20 | 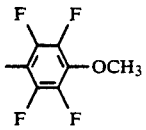 | 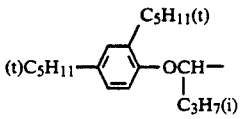 | —H | —Cl | 0 |
| C'-21 | 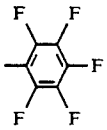 | 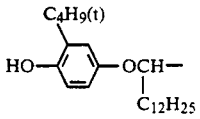 | —H | —Cl | 0 |

-continued
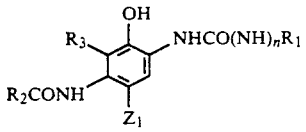
| Exemplified Compound No. | $R_1$ | $R_2$ | $R_3$ | $Z_1$ | n |
|---|---|---|---|---|---|
| C'-22 | 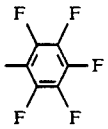 | 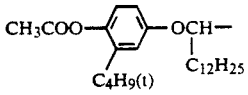 | —H | —Cl | 0 |
| C'-23 | 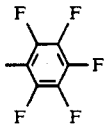 | 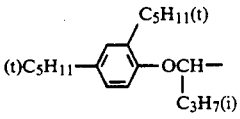 | —H | 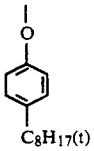 | 0 |
| C'-24 | 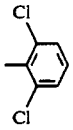 | 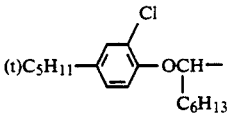 | —H | —Cl | 0 |
| C'-25 | 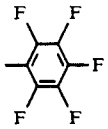 | 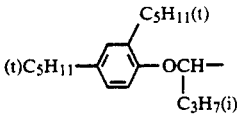 | —H | $OCH_2CONHCH_2CH_2OCH_3$ | 0 |
| C'-26 | 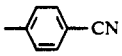 | 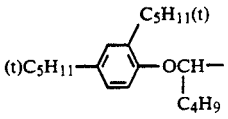 | —H | —H | 1 |
| C'-27 | 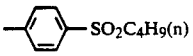 | 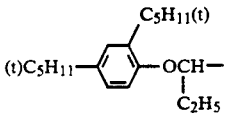 | —H | —H | 1 |
| C'-28 | 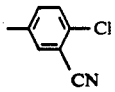 | 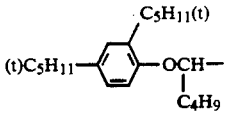 | —H | —H | 1 |
| C'-29 | 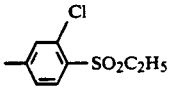 | 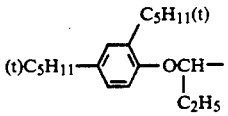 | —H | —Cl | 1 |
| C'-30 | 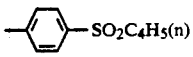 | 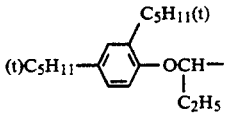 | —H | $OCH_2CONH(CH_2)_2OCH_3$ | 1 |
| C'-31 | 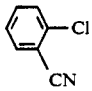 | 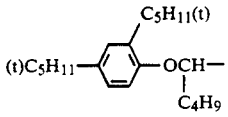 | —H | 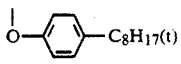 | 1 |

-continued
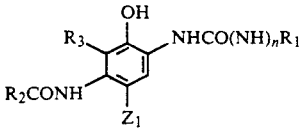
| Exemplified Compound No. | $R_1$ | $R_2$ | $R_3$ | $Z_1$ | n |
|---|---|---|---|---|---|
| C'-32 | 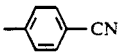 | 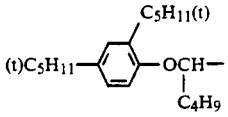 | —H | 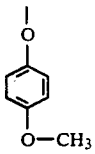 | 1 |
| C'-33 | $-C_3F_7(n)$ | 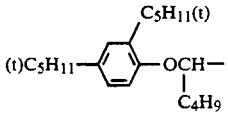 | —H | —H | 0 |
| C'-34 | $-C_3F_7(n)$ | 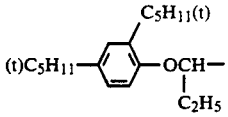 | —H | —H | 0 |
| C'-35 | 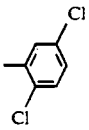 | 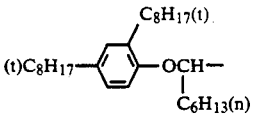 | —H | —H | 1 |
| C'-36 | 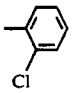 | 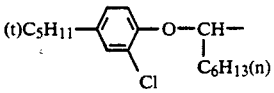 | —H | —Cl | 0 |
| C'-37 | 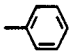 | 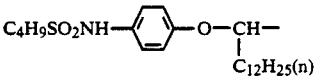 | —H | —Cl | 0 |
| C'-38 | 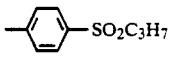 | 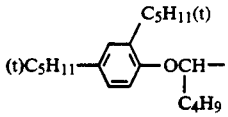 | —H | —H | 1 |
| C'-39 | 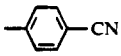 | 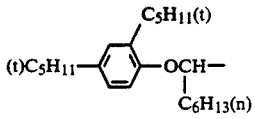 | —H | 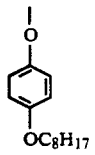 | 1 |
| C'-40 | 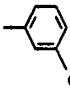 | 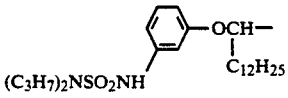 | —H | —Cl | 0 |
| C'-41 | 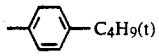 | 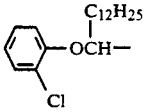 | —H | —Cl | 0 |

-continued
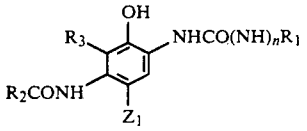
| Exemplified Compound No. | $R_1$ | $R_2$ | $R_3$ | $Z_1$ | n |
|---|---|---|---|---|---|
| C'-42 | 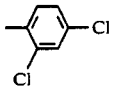 | 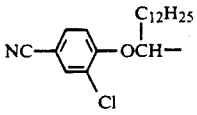 | —H | —Cl | 0 |
| C'-43 | 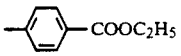 | 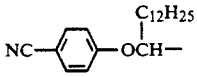 | —H | —Cl | 0 |
| C'-44 | 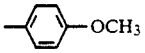 | 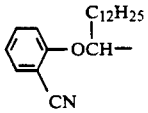 | —H | —F | 0 |
| C'-45 | 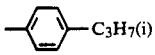 | 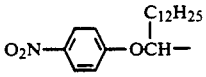 | —H | —Cl | 0 |
| C'-46 | 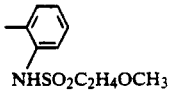 | 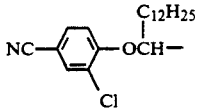 | —H | —Cl | 0 |
| C'-58 | 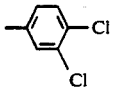 | 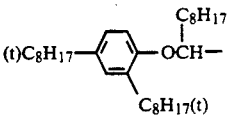 | —H | —Cl | 1 |
| C'-59 | 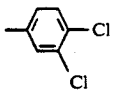 | 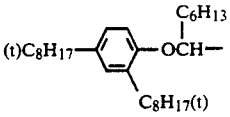 | —H | 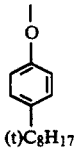 | 1 |
| C'-60 | 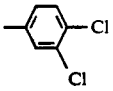 | 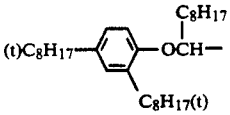 | —H | 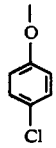 | 1 |
| C'-61 | 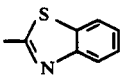 | 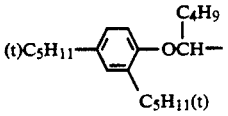 | —H | —H | 1 |
| C'-62 | 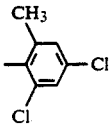 | 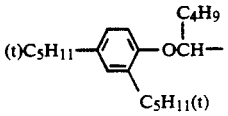 | —H | —Cl | 0 |

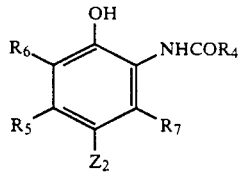
| Exemplified Compound No. | $R_5$ | $Z_2$ | $R_4$ | $R_7$ | $R_6$ |
|---|---|---|---|---|---|
| C''-1 | $-C_2H_5$ | $-H$ | 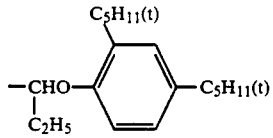 | $-H$ | $-Cl$ |
| C''-2 | $-C_2H_5$ | $-Cl$ | 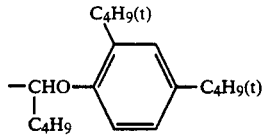 | $-H$ | $-Cl$ |
| C''-3 | $-C_2H_5$ | $-H$ | 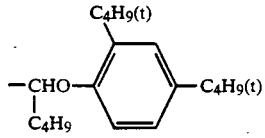 | $-H$ | $-Cl$ |
| C''-4 | $-C_2H_5$ | $-Cl$ | 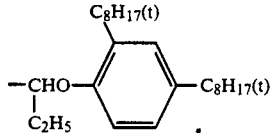 | $-H$ | $-Cl$ |
| C''-5 | $-C_2H_5$ | $-Cl$ | 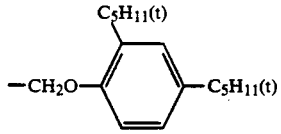 | $-H$ | $-Cl$ |
| C''-6 | $-C_2H_5$ | 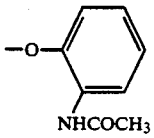 | 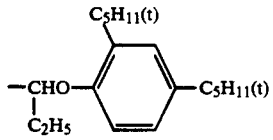 | $-H$ | $-Cl$ |
| C''-7 | 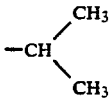 | $-Cl$ | 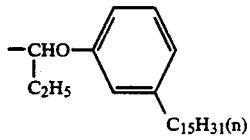 | $-H$ | $-Cl$ |
| C''-8 | $-C_2H_5$ | $-Cl$ | 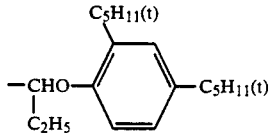 | $-H$ | $-Cl$ |

-continued
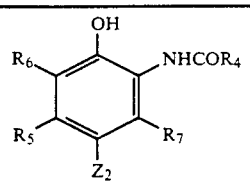
| Exemplified Compound No. | $R_5$ | $Z_2$ | $R_4$ | $R_7$ | $R_6$ |
|---|---|---|---|---|---|
| C''-9 | $-C_2H_5$ | $-Cl$ | 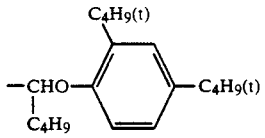 | $-H$ | $-Cl$ |
| C''-10 | $-C_4H_9$ | $-F$ | 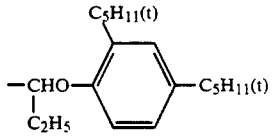 | $-H$ | $-Cl$ |
| C''-11 | $-C_2H_5$ | $-F$ | 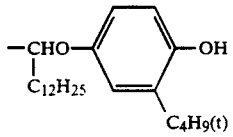 | $-H$ | $-Cl$ |
| C''-12 | $-C_2H_5$ | $-Cl$ | 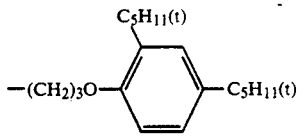 | $-H$ | $-Cl$ |
| C''-13 | $-C_2H_5$ | $-F$ | 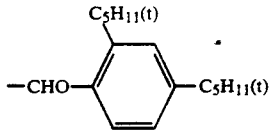 | $-H$ | $-Cl$ |
| C''-14 | $-C_4H_9$ | $-Cl$ | 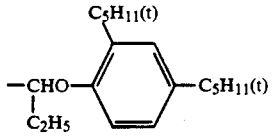 | $-H$ | $-Cl$ |
| C''-15 | $-C_2H_5$ | $-Cl$ | 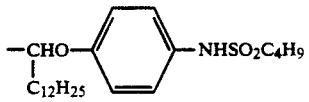 | $-H$ | $-Cl$ |
| C''-16 | $-C_2H_5$ | $-Cl$ | 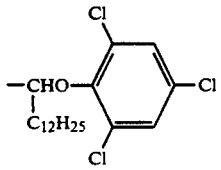 | $-H$ | $-Cl$ |
| C''-17 | 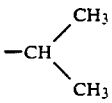 | $-Cl$ | $-C_{18}H_{37}$ | $-H$ | $-Cl$ |

-continued
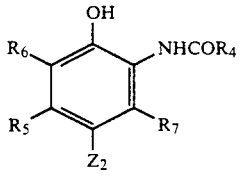
| Exemplified Compound No. | $R_5$ | $Z_2$ | $R_4$ | $R_7$ | $R_6$ |
|---|---|---|---|---|---|
| C''-18 | $-C_2H_5$ | $-F$ | 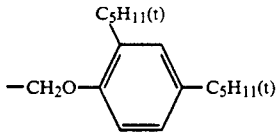 | $-H$ | $-Cl$ |
| C''-19 | $-C_2H_5$ | 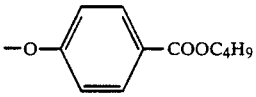 | 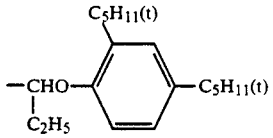 | $-H$ | $-Cl$ |
| C''-20 | $-C_2H_5$ | $-Cl$ | 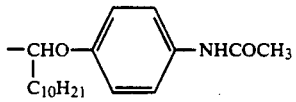 | $-H$ | $-Cl$ |
| C''-21 | $-C_3H_7$ | $-Cl$ | 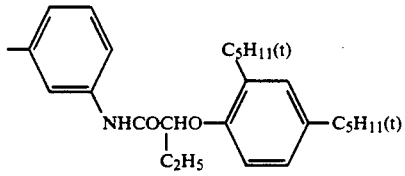 | $-H$ | $-Cl$ |
| C''-22 | $-C_3H_7$ | $-Cl$ | 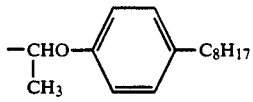 | $-H$ | $-Cl$ |
| C''-23 | $-C_2H_4NHCOCH_3$ | $-Cl$ | 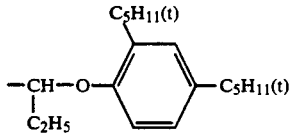 | $-H$ | $-Cl$ |
| C''-24 | $-C_3H_6OCH_3$ | $-Cl$ | 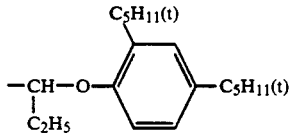 | $-H$ | $-Cl$ |
| C''-25 | $-H$ | $-Cl$ | 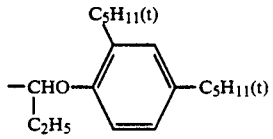 | $-C_2H_5$ | $-Cl$ |
| C''-26 | $-H$ | $-Cl$ | 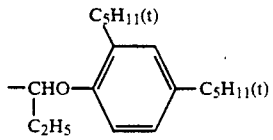 | $-C_3H_7$ | $-Cl$ |

-continued
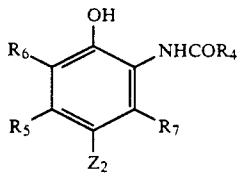
| Exemplified Compound No. | $R_5$ | $Z_2$ | $R_4$ | $R_7$ | $R_6$ |
|---|---|---|---|---|---|
| C''-27 | —H | —Cl | 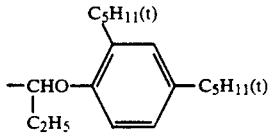 | —$C_5H_{11}$ | —Cl |
| C''-28 | —$C_2H_5$ | —Cl | 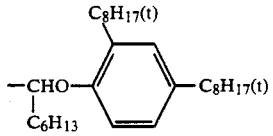 | —H | —Cl |
| C''-29 | —$C_2H_5$ | —Cl | 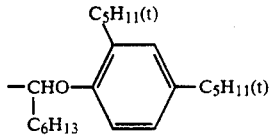 | —H | —Cl |
| C''-30 | —$C_4H_9$ | —Cl | 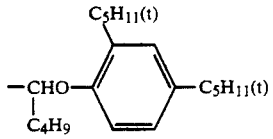 | —H | —Cl |
| C''-31 | —$C_4H_9$ | —Cl | 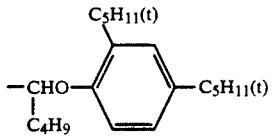 | —H | —$CH_3$ |
| C''-32 | —$C_{15}H_{31}$ | —Cl | 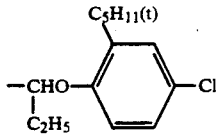 | —H | —Cl |
| C''-33 | 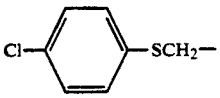 | —Cl | 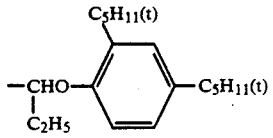 | —H | —Cl |
| C''-34 | $C_3F_7CONHCH_2$— | —Cl | 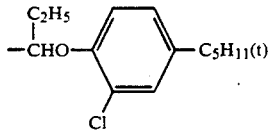 | —H | —Cl |

-continued
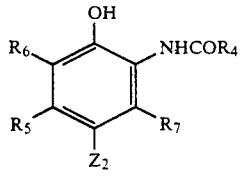
| Exemplified Compound No. | $R_5$ | $Z_2$ | $R_4$ | $R_7$ | $R_6$ |
|---|---|---|---|---|---|
| C''-35 | $CH_3OCH_2$— | —Cl | 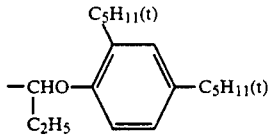 | —H | —Cl |
| C''-36 | —$C_2H_5$ | —$OCH_2CH_2CH_2COOH$ | 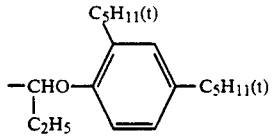 | —H | —Cl |
The preferably applicable yellow couplers include the yellow couplers having high reaction rate such as those exemplified below.
(Y'-1)
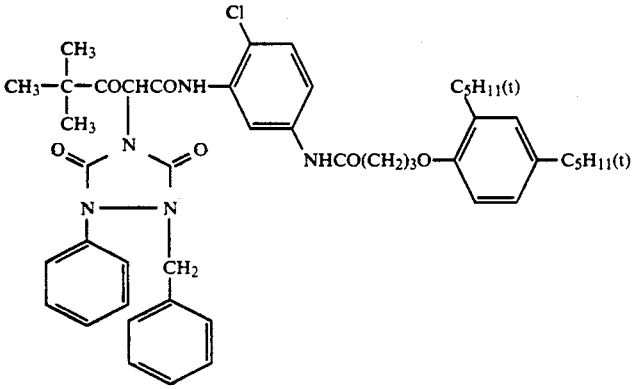
(Y'-2)
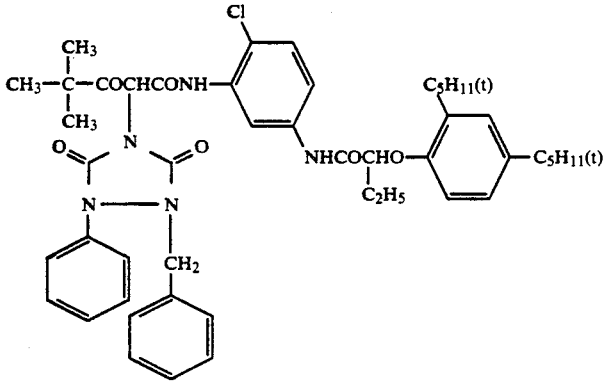

-continued
(Y'-3)
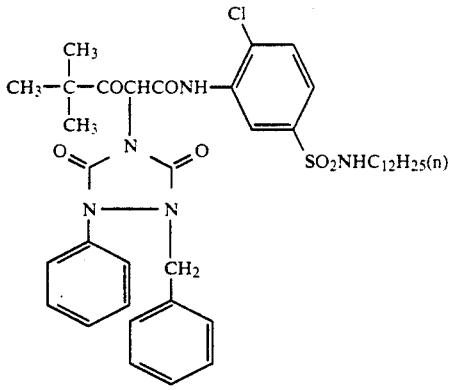
(Y'-4)
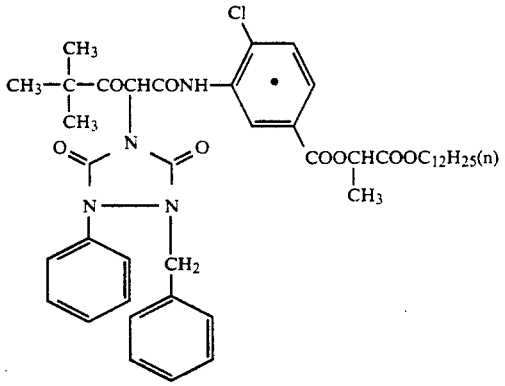
(Y'-5)
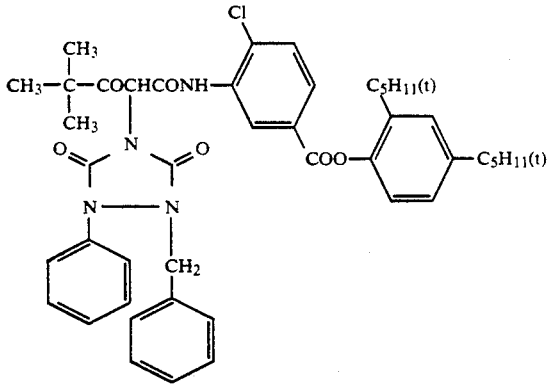
(Y'-6)
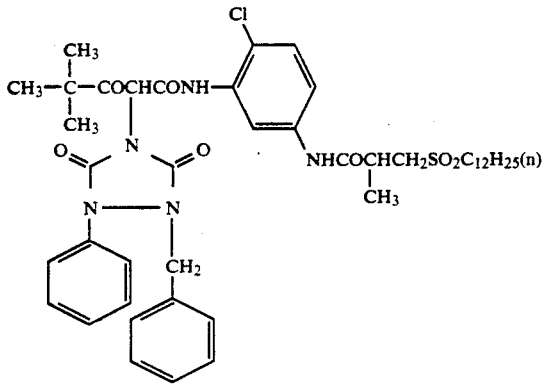

-continued
(Y'-7)
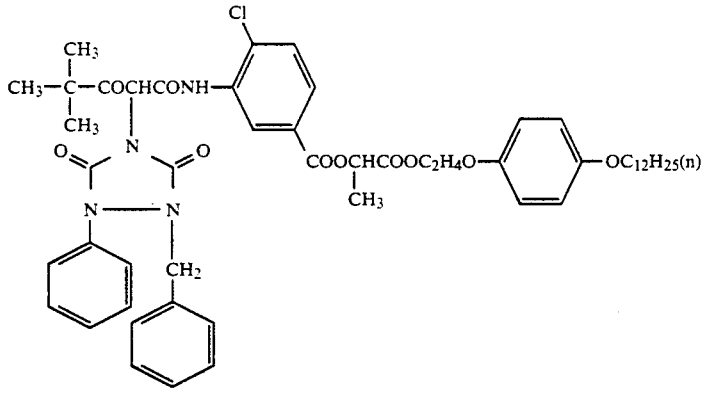
(Y'-8)
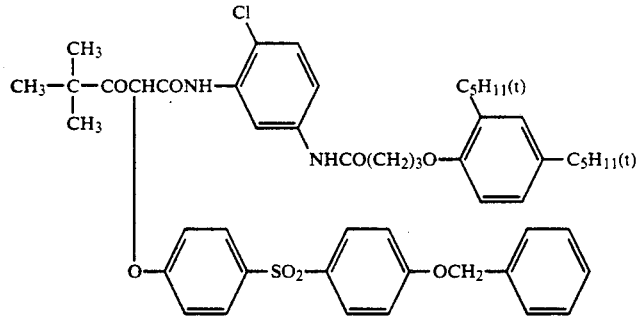
(Y'-9)
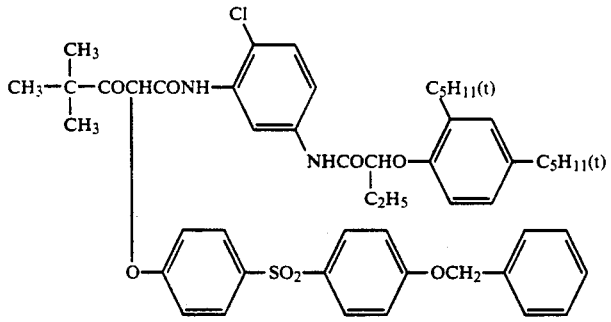
(Y'-10)
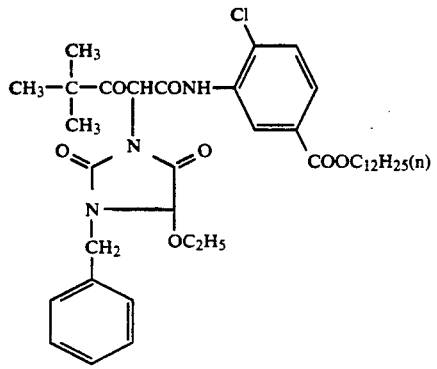

-continued
(Y'-11)
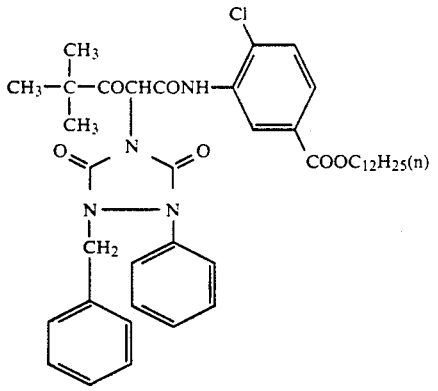
(Y'-12)
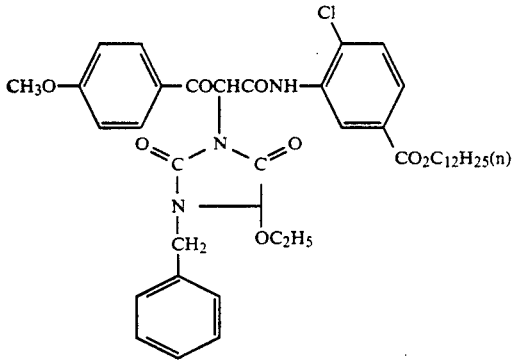
(Y'-13)
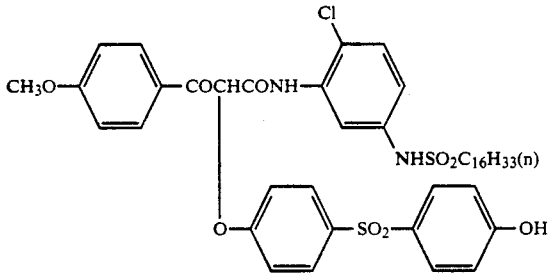
(Y'-14)
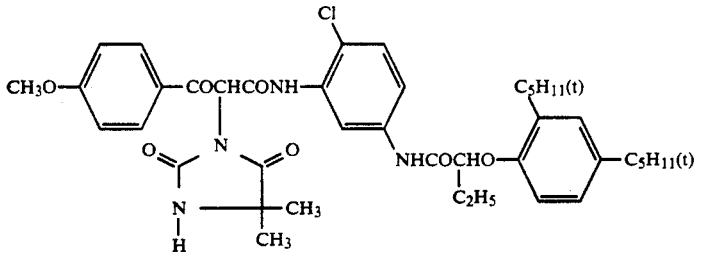
(Y'-15)
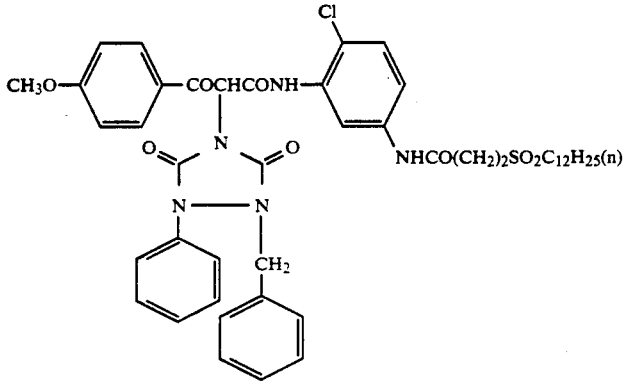

-continued
(Y'-16)
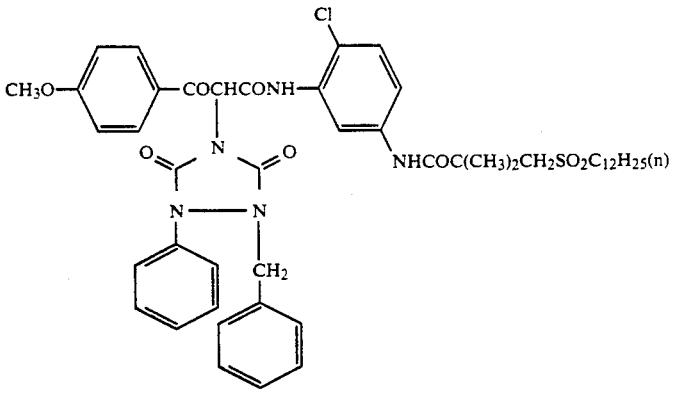
(Y'-17)
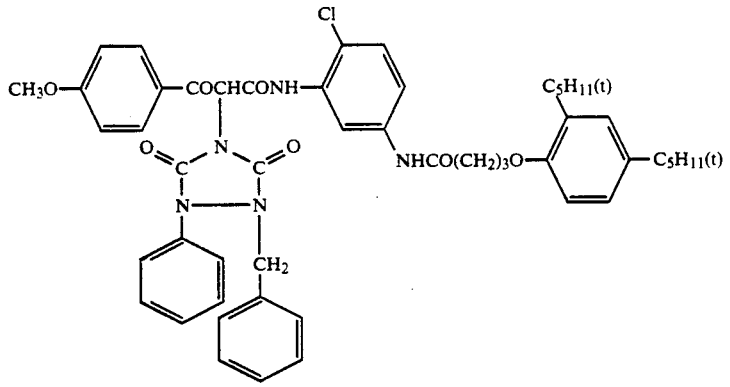
(Y'-18)
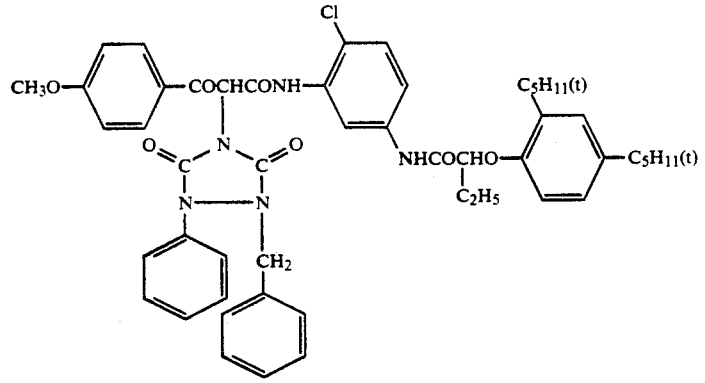
(Y'-19)
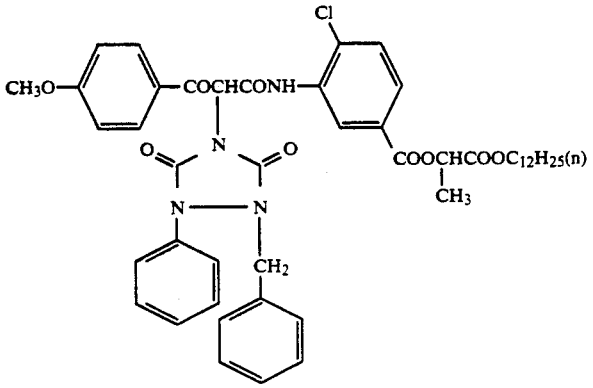

-continued
(Y'-20)
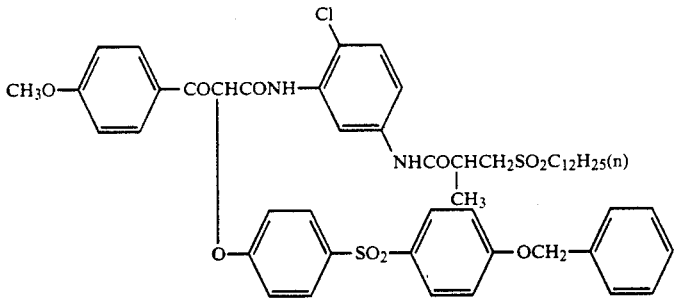
(Y'-21)
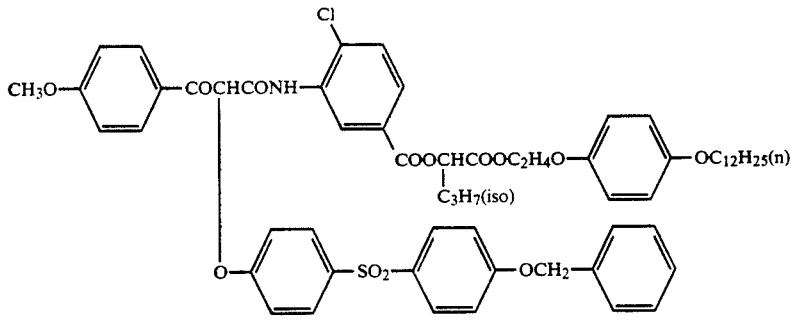
(Y'-22)
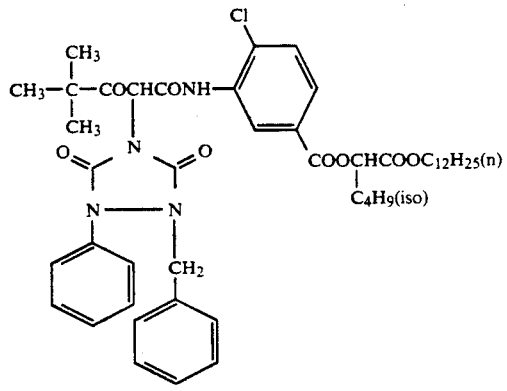
(Y'-23)
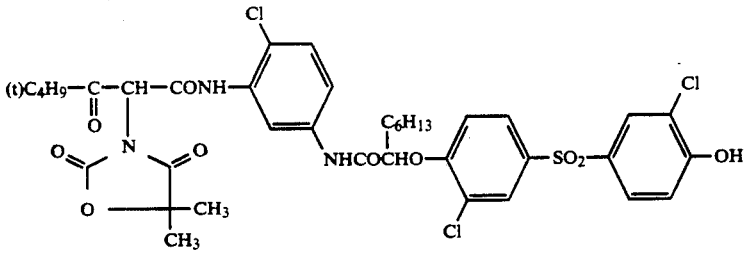
(Y'-24)
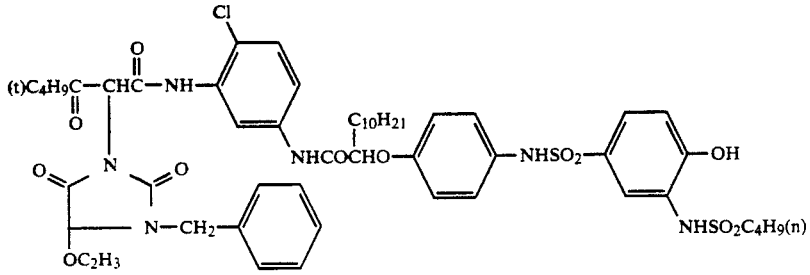

-continued
(Y'-25)
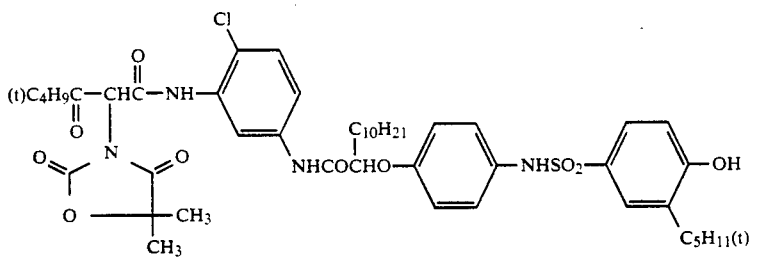
(Y'-26)
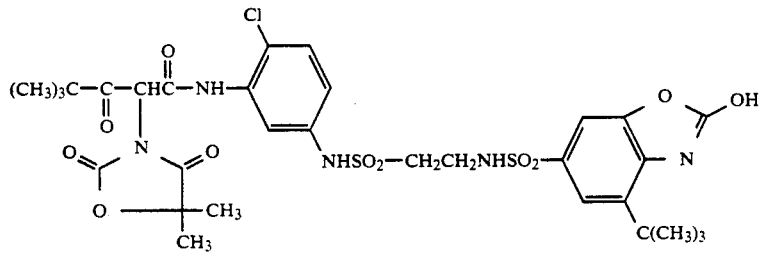
(Y'-27)
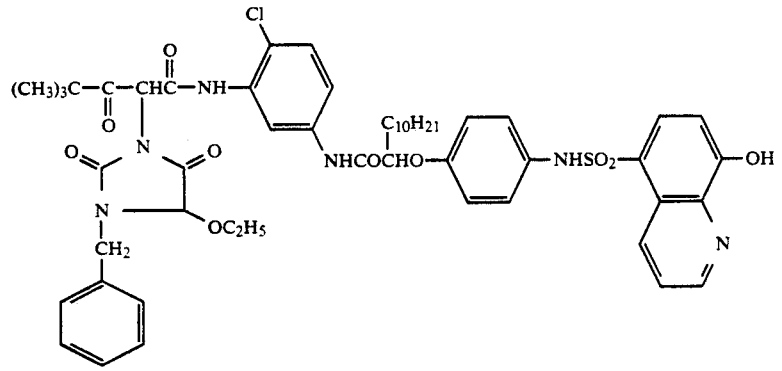
(Y'-28)
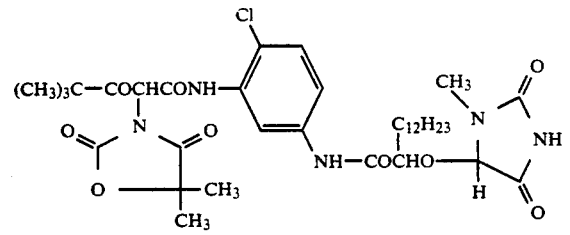
(Y'-29)
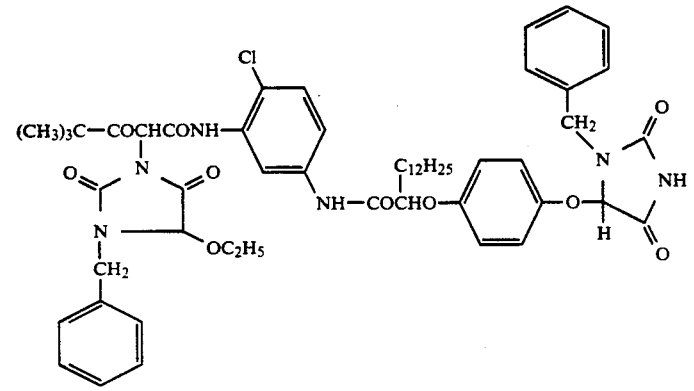

-continued
(Y'-30)
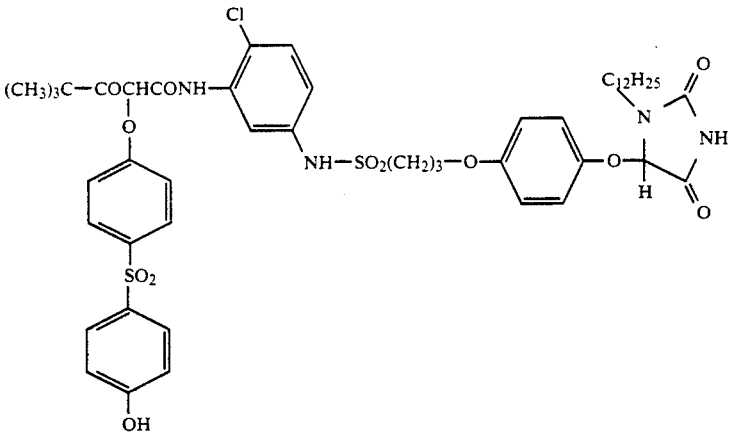
(Y'-31)
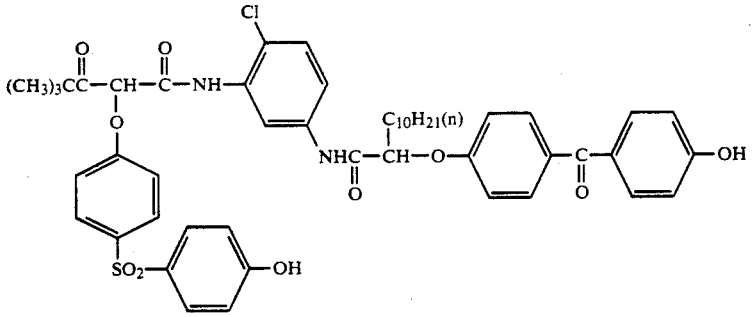
(Y'-32)
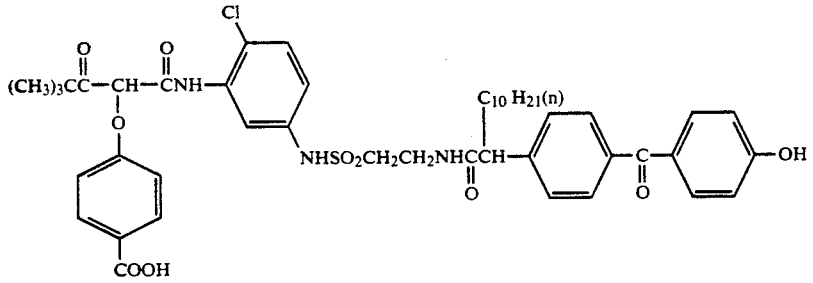
(Y'-33)
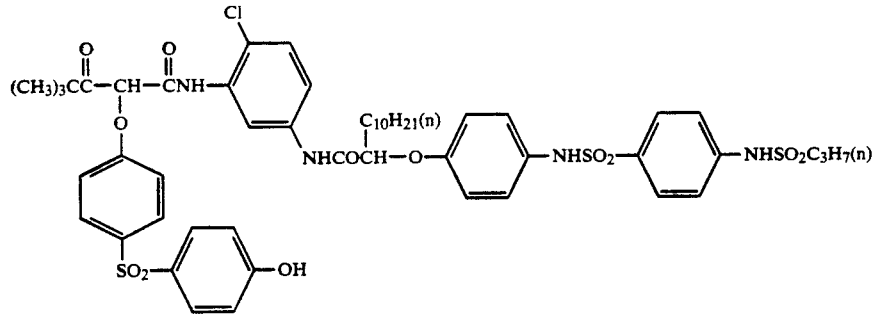
(Y'-34)
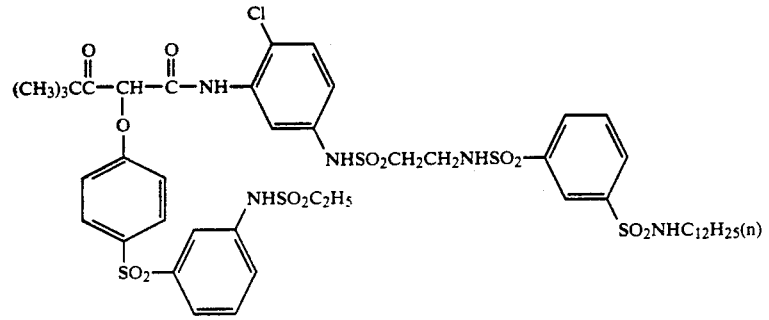

-continued
(Y'-35)
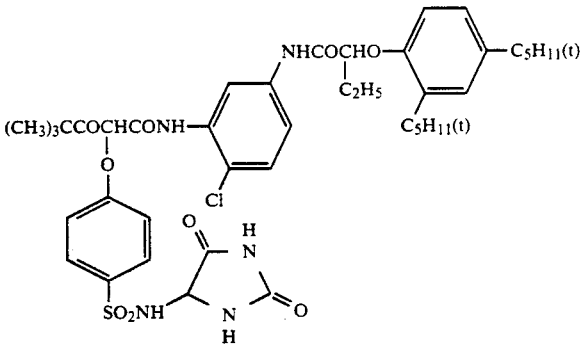
(Y'-36)
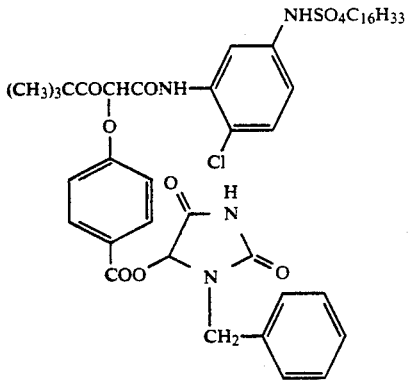
(Y'-37)
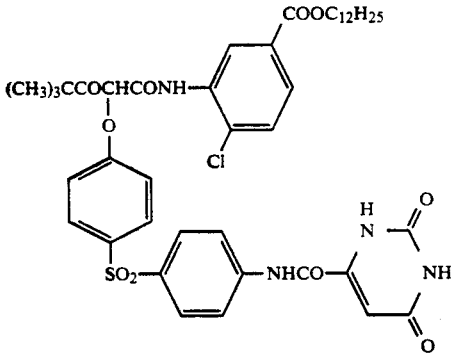
(Y'-38)
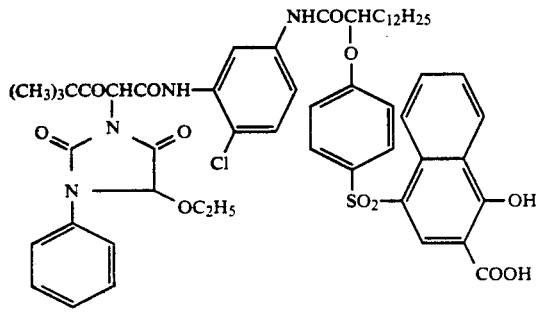

-continued (Y'-39)

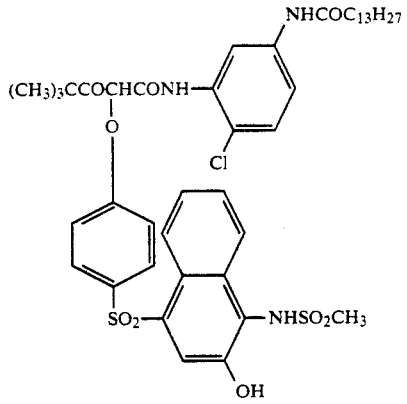

In the invention, when using a light-sensitive material subject to processing, particularly a highly silver chloride-containing light-sensitive material, and a nitrogen-containing heterocyclic mercapto compound in combination, another effect can be displayed to make bleach-fixability excellent as well as the objects of the invention can effectively be achieved and any bad influences on the photographic characteristics of the light-sensitive material caused by mingling bleach-fixer to color developer can be made very slight. This embodiment may be given as one of the preferable embodiments of the invention.

As for the nitrogen-containing heterocyclic mercapto compounds, the following ones described in Japanese Patent O.P.I. Publication No. 63-106655(1988) may be exemplified.

I'-1

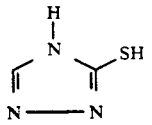

I'-2

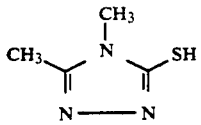

I'-3

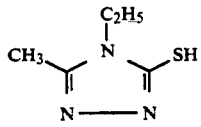

I'-4

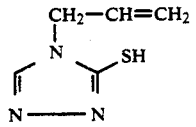

I'-5

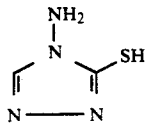

-continued

I'-6

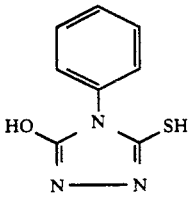

I'-7

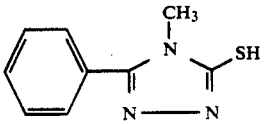

I'-8

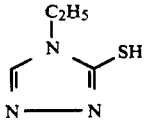

I'-9

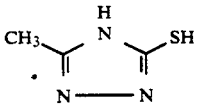

I'-10

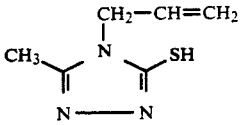

I'-11

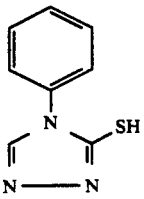

I'-12

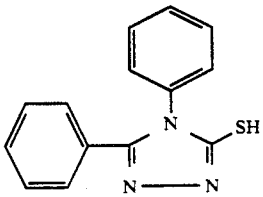

-continued
I'-13
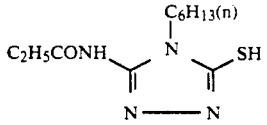
I'-14
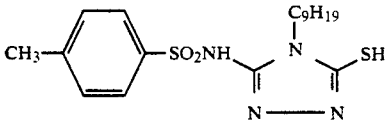
I'-15
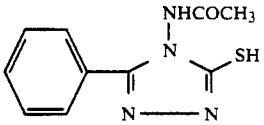
I'-16
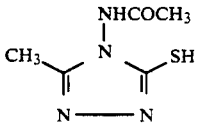
I'-17
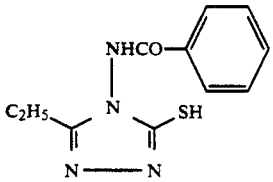
I'-18
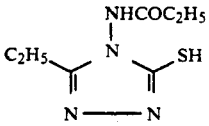
I'-19
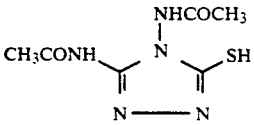
I'-20
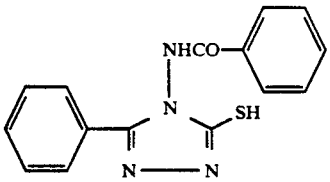
I'-21
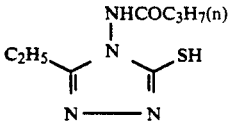
I'-22
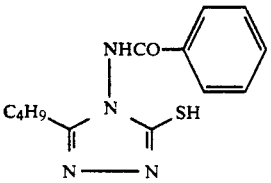
-continued
I'-23
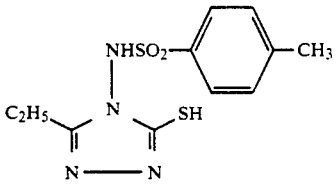
I'-24
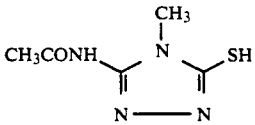
I'-25
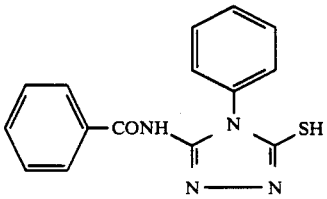
I'-26
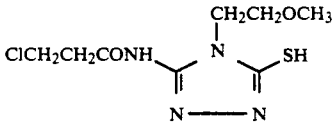
I'-27
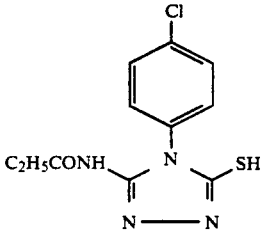
I'-28
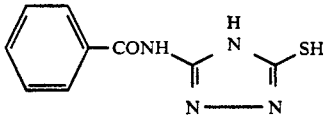
I'-29
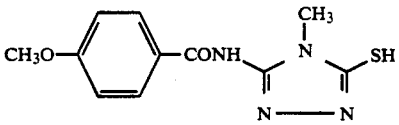
I'-30
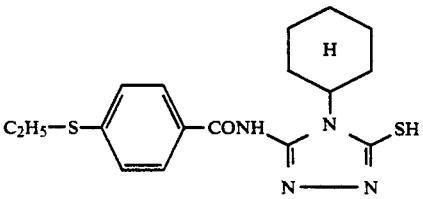
I'-31
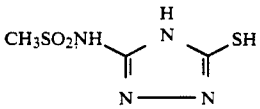

-continued
I'-32
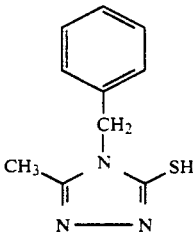
I'-33
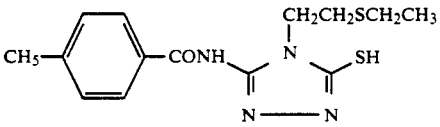
I'-34
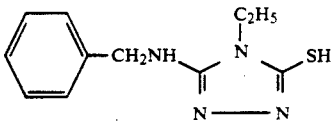
I'-35
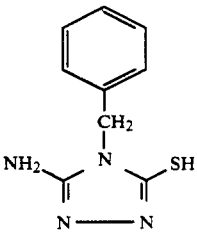
I'-36
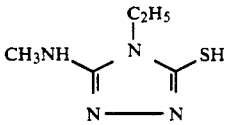
I'-37
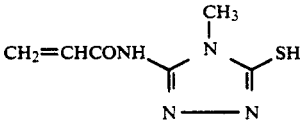
I'-38
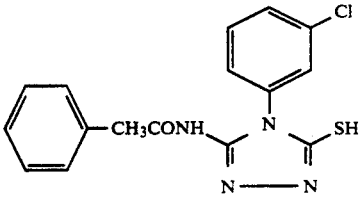
I'-39
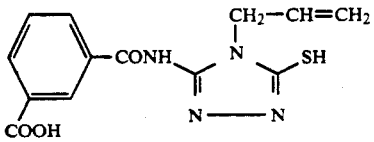
I'-40
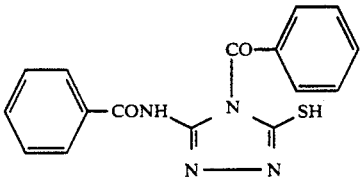
-continued
I'-41
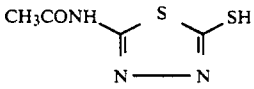
I'-42
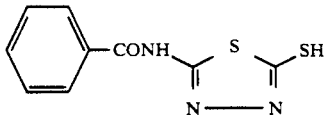
I'-43
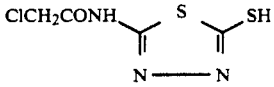
I'-44
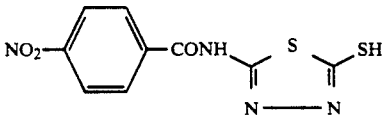
I'-45
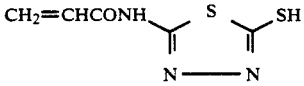
I'-46
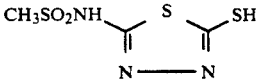
I'-47
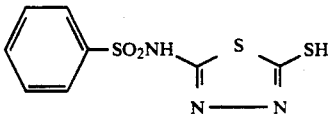
I'-48
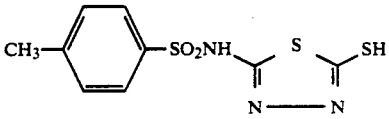
I'-49
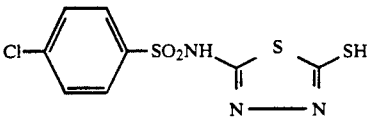
I'-50
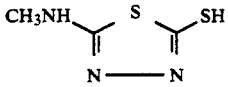
I'-51
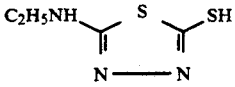
I'-52
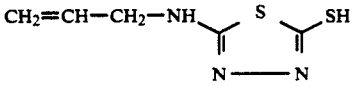
I'-53
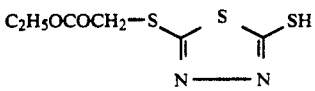
I'-54
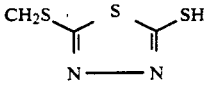

-continued
I'-55
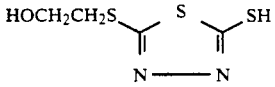
I'-56
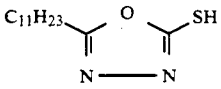
I'-57
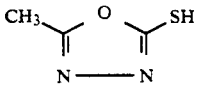
I'-58
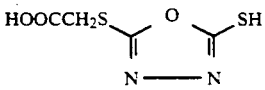
I'-59
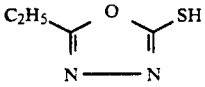
I'-60
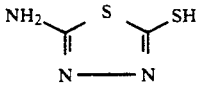
I'-61
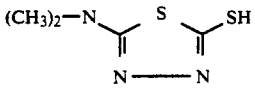
I'-62
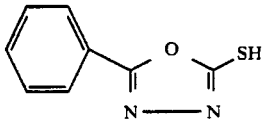
I'-63
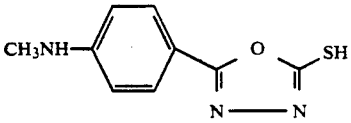
I'-64
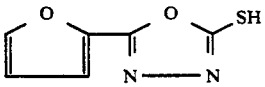
I'-65
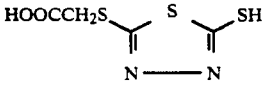
I'-66
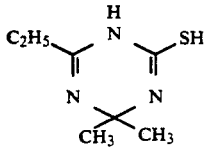
I'-67
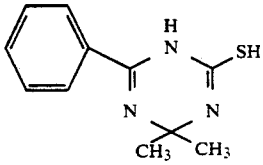
-continued
I'-68
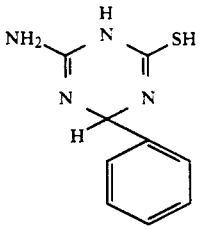
I'-69
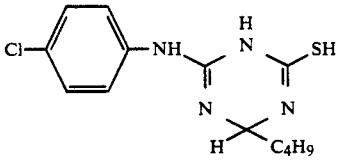
I'-70
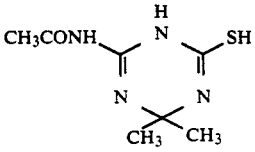
I'-71
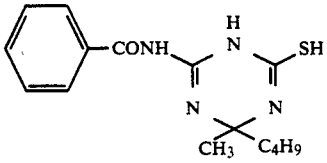
I'-72
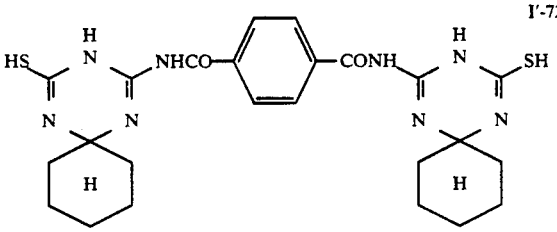
I'-73
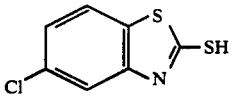
I'-74
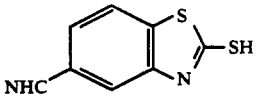
I'-75
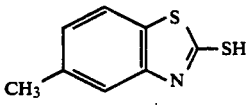
I'-76
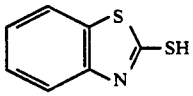
I'-77
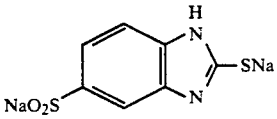

-continued

I'-78

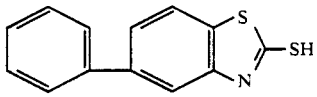

I'-79

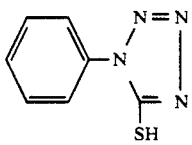

I'-80

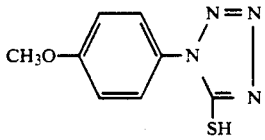

I'-81

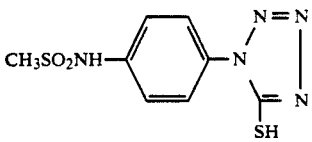

I'-82

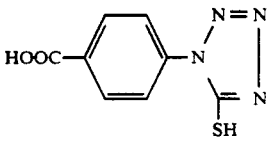

I'-83

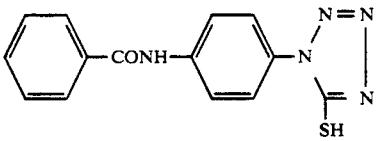

I'-84

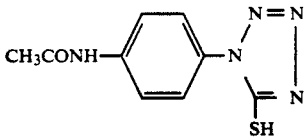

I'-85

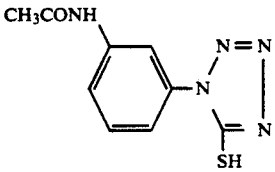

I'-86

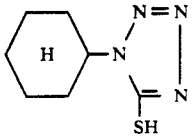

-continued

I'-87

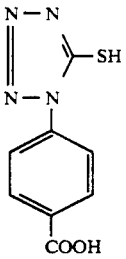

Silver halide emulsion containing silver chloride in a proportion of not less than 90 mol %, which is preferably applicable to the invention, may be prepared in any ordinary preparation methods such as single- or double-jet method in which the components are supplied constantly or acceleratingly. Among the preparation methods, the particularly preferable method is to use the double-jet system while adjusting a pAg. For further details, refer to Research Disclosure, No. 17643, Sections I and II.

Silver halide emulsions may be chemically sensitized. In particular, sulfur-containing compounds such as allylisothiocyanate, allylthiourea, and thiosulfate, may preferably be used for this purpose. Reducing agents may also be used as a chemical sensitizer. Such reducing agents include, for example, tin compounds described in Belgian Patent Nos. 493,464 and 568,687; and polyamines such as diethylenetriamine, or aminomethylsulfinic acid derivatives, described in Belgian Patent No. 547,323. Noble metals such as gold, platinum, palladium, iridium, ruthenium, and rhodium, and noble metal compounds may also suitable be used as a sensitizer. The chemically sensitizing methods are described in R Koslowsky's treatise appeared in Z. Wiss. Photogr., 46, pp. 65–72, 1951, and the aforegiven Research Disclosure, No. 17643, Section III may also be referred.

Silver halide emulsions can be optically sensitized in a well known method, by making use of an ordinary polymethine dye such as those of neutrocyanine, basic or acidic carbocyanine, rhodacyanine, and hemicyanine, a styryl dye, oxonol, and the similar substances thereto. For further details, refer to F. M. Hamer, 'The Cyanine Dyes and Related Compounds', 1964, Ullmanns Enzyklopadie der Technischen Chemie, 4th Ed., Vol. 18, p. 431, and the aforegiven Research Disclosure, No. 17643, Section IV.

Antifoggants and stabilizers each in common use may be applied to the silver halide emulsions. Azaindenes are particularly suitable stabilizers and, among them, tetra- and pentaazaindenes, and those substituted with a hydroxyl or amino group in particular, are preferable for the stabilizers. These kinds of compounds are given in, for example, Birr's treatize in Z. Wiss. Photogr., 47, 1952, pp. 2–58, and the aforegiven Research Disclosure, No. 17643, Section IV.

These components can be incorporated into the light-sensitive material in a commonly known method. For further details, refer to U.S. Pat. Nos. 2,322,027, 2,533,514, 3,689,271, 3,764,336 and 3,765,897.

Some components such as a coupler and a UV absorbent, may also be incorporated in the form of the charged latex. For further details, refer to West German OLS Patent No. 2,541,274 and European Patent Publication No. 14,921. Such components can also be fixed as a polymer into the light-sensitive material. For the details, refer to West German OLS Patent No. 2,044,992, and U.S. Pat. Nos. 3,370,952 and 4,080,211.

As for the supports of the light-sensitive materials, the ordinary types of supports may be used. They include, for example, cellulose ester supports such as those of cellulose acetate, and polyester supports. Besides, paper supports are also suitable for this purpose, and they may coated with, for example, polyolefin or, in particular, polyethylene or polypropylene. For further details thereof, refer to the aforegiven Research Disclosure, No. 17643, Sections V and VI.

Ordinary types of hydrophilic film forming materials may also be used for a protective colloid or a binder applicable to the layers of a light-sensitive material. These film forming materials include, for example, proteins such as gelatin in particular, alginic acid and the esters thereof, amides and the derivatives thereof such as the salts thereof, cellulose derivatives such as carboxymethyl cellulose and cellulose sulfate, starch and the derivatives thereof, or hydrophilic synthetic-binders. Besides, the binders given in the aforegiven Research Disclosure No. 17643, Section IX may also be referred.

The layers constituting a photographic light-sensitive material, which are provided onto the support, may be hardened by making use of, for example, a hardener of the epoxide type, heterocyclic ethyleneimine type or acryloyl type. Furthermore, photographic component layers may be hardened in accordance with the method described in West German OLS Patent No. 2218,009 so that a color photographic light-sensitive material may be so prepared as to be suitable for a high temperature processing. On the other hand, such layers may also be hardened with a hardener of the diazine, triazine or 1,2-dihydroquinoline type, or a hardener of the vinyl sulfone type. Other suitable hardeners are disclosed in, for example, West German OLS Patent Nos. 2,439,551, 2,225,230 and 2,317,672, and the aforegiven Research Disclosure, No. 17643, Section XI.

According to the invention, it is possible to provide a light-sensitive material processing solution capable of displaying rapid bleach-fixability and excellent processing stability, and preventing a light-sensitive material subject to processing from producing reticulations or edge-stains; and to provide the processing method thereof.

EXAMPLE

The invention will now be detailed with reference to the following examples. It is, however, to be understood that the embodiments of the invention shall not be limited to the examples.

EXAMPLE 1

An experiment was tried by making use of the color paper, processing solution and by following the processing steps, each detailed below.

Color Paper

A light-sensitive material was prepared by coating the following layers on a polyethylene-laminated paper support in order from the support.

Beforehand, the polyethylene-laminated paper support used therein had been prepared in the following manner. Two hundred parts by weight of polyethylene having an average molecular weight of 100,000 and a density of 0.95 and 20 parts by weight of polyethylene having an average molecular weight of 2,000 and a density of 0.80 were mixed together, and the mixture was added with anatase type titanium oxide in a proportion of 7.0% by weight. The resulting matter was coated on the surface of wood free paper of 165 g/m$^2$ in an extrusion-coating method so as to form a 0.035 mm thick coated layer. On the rear surface of the paper was coated with polyethylene only so as to form a 0.04 mm thick coated layer. The surface of the polyethylene layer coated on the surface of the resulting support was subjected to a corona-discharge pretreatment and, then, the following layers were coated thereon in order.

Layer 1

This layer was a blue-sensitive silver halide emulsion layer comprising a silver halide emulsion containing AgCl of 99 mol % and AgBr of 1 mol %. The emulsion was incorporated thereinto with gelatin in an amount of 340 g per mol of the silver halides used and was sensitized with the following structured sensitizing dye, solved in isopropyl alcohol in an amount of $2.5\times10^{-4}$ mol,

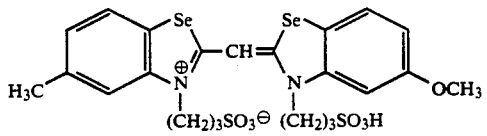

The emulsion layer was also incorporated thereinto with 200 mg/m$^2$ of 2,5-di-t-butyl hydroquinone and a mixture in a 1:1-proportion of the following yellow couplers Y-1 and Y-2 in an amount of $2\times10^{-1}$ mol per mol of the silver halide used which had been dissolved in dibutyl phthalate and dispersed. The emulsion layer was so coated as to make the silver content thereof be 280 mg/m$^2$.

Layer 2

This layer was a gelatin layer containing 300 mg/m$^2$ di-t-octyl hydroquinone and 200 mg/m$^2$ of UV-absorbent comprising a mixture in a 1:1:1:1-proportion of 2-(2'-hydroxy-3',5'-di-t-butyl phenyl-benzotriazole, 2-(2'-hydroxy-5-'-t-butyl phenyl)benzotriazole, 2-(2'-hydroxy-3'-t-butyl-5'-methylphenyl)-5-chlorobenzotriazole, and 2-(2-hydroxy-3',5'-di-t-butyl phenyl)-5-chlorobenzotriazole, which had been dissolved in dibutyl phthalate and dispersed. The gelatin layer was so coated as to make the gelatin content thereof be 1,800 mg/m$^2$.

Layer 3

This layer was a green-sensitive silver halide emulsion layer comprising a silver halide emulsion containing AgCl of 99 mol % and AgBrI of 1 mol %. The emulsion was incorporated thereinto with 400 g of gelatin per mol of the silver halides used and was sensitized with the following structured sensitizing dye in an amount of $2.6\times10^{-4}$ mol per mol of the silver halide used,

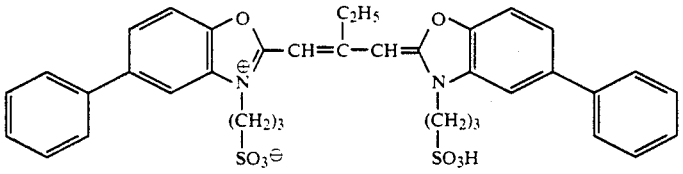

and the resulting sensitized emulsion was incorporated thereinto with the following magenta coupler M-1 in an amount of $1.6\times10^{-1}$ mol per mol of the silver halide used, which had been dissolved in a solvent of a 2:1-mixture of dibutyl phthalate and tricresyl phosphate and dispersed in the emulsion. The resulting emulsion was so coated as to make the silver content thereof be 250 mg/m$^2$. Furthermore, an oxidation inhibitor, 2,2,4-trimethyl-6-lauryloxy-7-t-octyl chroman, in an amount of 0.3 mol per mol of the coupler was incorporated thereinto.

Layer 4

This layer was a gelatin layer containing 31 mg/m$^2$ of di-t-octyl hydroquinone and 490 mg/m$^2$ of a UV-absorbent comprising a mixture of 2-(2'-hydroxy-3',5'-di-t-butyl phenyl)benzotriazole, 2-(2'-hydroxy-5'-t-butyl phenyl)benzotriazole, 2-(2'-hydroxy-3'-t-butyl-5'-methyl phenyl)-5'-chlorobenzotriazole, and 2-(2'-hydroxy-3',5'-di-t-butyl phenyl)-5-chlorobenzotriazole in a proportion of 2:1.5:1.5:2 dissolved in dioctyl phthalate and dispersed. The resulting gelatin layer was so coated as to make the gelatin content thereof be 2,000 mg/m$^2$.

Layer 5

This layer was a red-sensitive silver halide emulsion layer comprising a silver halide emulsion containing AgCl of 99 mol % and AgBr of 1 mol %. The emulsion was incorporated thereinto with 480 g of gelatin per mol of the silver halides used and was sensitized with the following structured sensitizing dye in an amount of $2.4\times10^{-4}$ mol per mol of the silver halide used,

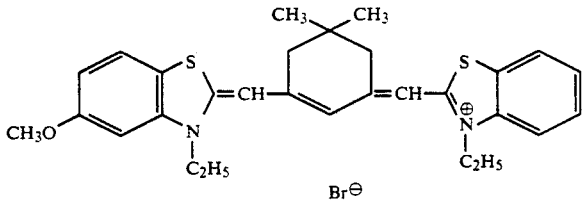

The emulsion layer was incorporated thereinto with 150 mg/m$^2$ of 2,5-di-t-butyl hydroquinone and a 1:1-mixture of the following cyan couplers C-1 and C-2 in an amount of $3.5\times10^{-1}$ mol per mol of the silver halide used which had been dispersed in dibutyl phthalate and dispersed. The resulting emulsion was so coated as to make the silver content thereof be 270 mg/m$^2$.

Layer 6

This layer was a gelatin layer which was so coated as to make the gelatin content thereof be 1,000 mg/m$^2$.

The silver halide emulsions applied to the light-sensitive emulsion layers, namely, Layers 1, 3 and 5, were each prepared in the method described in Japanese Patent Examined Publication No. 46-7772(1971). The emulsions were sensitized chemically with sodium thiosulfate pentahydrate and chloroauric acid, and were then incorporated with hydroxy-6-methyl-1,3,3*a*,7-tetrazaindene as a stabilizer, bis(vinylsulfonylmethyl)ether as a hardener, and saponin as a coating aid.

Yellow Coupler Y-1

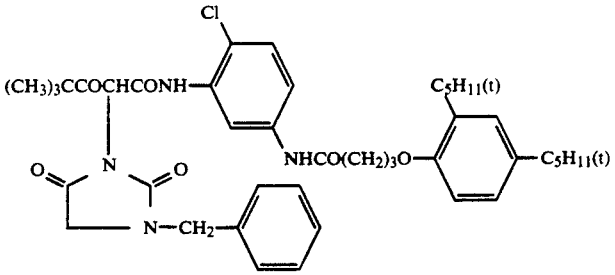

Yellow Coupler Y-2

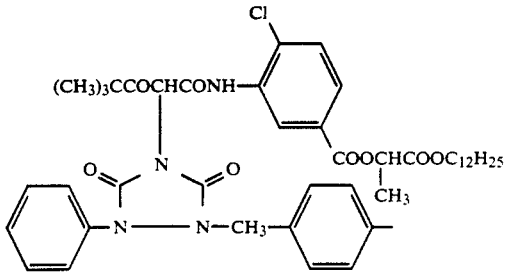

-continued

Magenta Coupler M-1

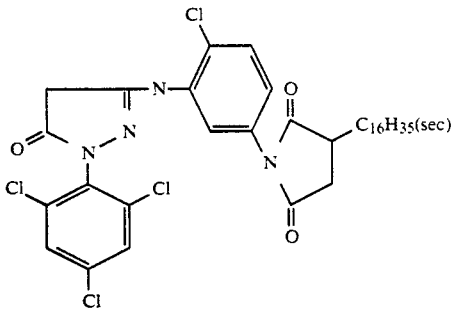

Cyan Coupler C-1

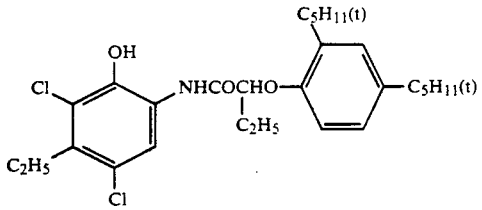

Cyan Coupler C-2

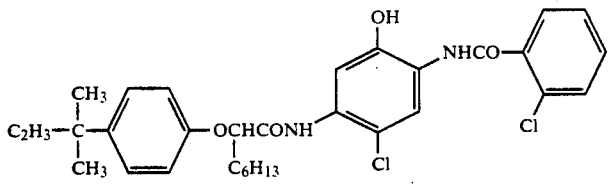

The above-mentioned light-sensitive material was exposed stepwise to light and was then processed in the following processing steps and processing solutions.

| Processing step | Processing temperature | Processing time |
|---|---|---|
| 1. Developing | 40° C. | 20 seconds |
| 2. Bleach-fixing | 40° C. | See Table 1 |
| 3. Stablilizing in a single tank | 40° C. | 20 seconds |
| 4. Drying | 60–80° C. | 30 seconds |

The color developer, bleach-fixer and stabilizer having the following compositions were used.

| | |
|---|---|
| Color developer | |
| Potassium sulfite | 0.3 g |
| Potassium bromide | 0.02 g |
| Sodium chloride | 3.0 g |
| Potassium carbonate | 30.0 g |
| Diethylhydroxylamine | 8.0 g |
| Diethylenetriaminepentaacetic acid | 1.0 g |
| 3-methyl-4-amino-N-ethyl-N-(β-methanesulfoneamidoethyl)-aniline sulfate | 7.5 g |
| Fluorescent whitening agent, Kaycoll-PK-Conc manufactured by Nippon Soda Co. | 1.0 g |
| Added water to make | 1 liter |
| Adjusted pH with the use of potassium hydroxide to | pH 10.20 |
| Bleach-fixer | |

-continued

| | |
|---|---|
| Ferric ammonium salts represented by Formula 1 | See Table 1 |
| Ethylenediaminetetraacetic acid | 3 g |
| Fixer | See Table 1 |
| Ammonium sulfite in a 40% solution | 27.5 ml |
| 2-amino-5-mercapto-1,3,4-thiazole | 1.0 g |
| Added water to make | 1 liter |
| Adjusted pH with the use of potassium carbonate to | pH 7.0 |
| Stabilizer | |
| Hydroxyethylidene-1,1-diphosphonic acid | 1.0 g |
| Zinc sulfate heptahydrate | 0.4 g |
| Polyvinyl pyrolidone | 0.5 g |
| Ammonium hydroxide in a 28% solution | 3 g |
| Adjusted pH with sulfuric acid and potassium hydroxide to | pH 7.1 |

After the processing was completed, the residual silver content of each sample was measured through X-ray fluorescence X-rays. The reticulations of the processed samples were observed and the degrees thereof were evaluated. As the results of the evaluations, the samples were ranked A when no reticulation was found, B when a few reticulations were found, and C when too many reticulations were found to put into practical use, respectively. The term, 'reticulation', stated herein means a phenomenon that fine wrinkles are found on an emulsion surface. The results of the evaluations of the reticulations are shown in Table 1.

TABLE 1

In the table: FAS means ferric ammonium salt
ATS means ammonium thiosulfate
ATC means ammonium thiocyanate

| Sample No. | Bleach-fixing time (sec.) | Bleaching agent (mol/l) | Fixer (mol/l) | Residual silver (mg/100 $cm^2$) | Reticu-lation | Remark |
|---|---|---|---|---|---|---|
| 1-1 | 20 | 1-2 FAS 0.1 | ATS 1.2 | 2.0 | C | Comparative |
| 1-2 | 20 | 1-2 FAS 0.15 | ATS 1.2 | 1.2 | C | Comparative |
| 1-3 | 20 | 1-2 FAS 0.17 | ATS 1.2 | 1.0 | B | Comparative |
| 1-4 | 20 | 1-2 FAS 0.20 | ATS 1.2 | 0.5 | A | Invention |
| 1-5 | 20 | 1-2 FAS 0.25 | ATS 1.2 | 0.3 | A | Invention |
| 1-6 | 20 | 1-2 FAS 0.35 | ATS 1.2 | 0.3 | A | Invention |
| 1-7 | 20 | 1-2 FAS 0.40 | ATS 1.2 | 0.3 | A | Invention |
| 1-8 | 20 | 1-2 FAS 0.35 | ATS 0.4 | 3.0 | C | Comparative |
| 1-9 | 20 | 1-2 FAS 0.35 | ATS 0.6 | 1.5 | C | Comparative |
| 1-10 | 20 | 1-2 FAS 0.35 | ATS 0.65 | 1.0 | B | Comparative |
| 1-11 | 20 | 1-2 FAS 0.35 | ATS 0.70 | 0.5 | A | Invention |
| 1-12 | 20 | 1-2 FAS 0.35 | ATS 0.90 | 0.3 | A | Invention |
| 1-13 | 20 | 1-2 FAS 0.35 | ATS 1.5 | 0.3 | A | Invention |
| 1-14 | 20 | 1-2 FAS 0.35 | ATS 3 | 0.3 | A | Invention |
| 1-15 | 20 | 1-2 FAS 0.35 | ATC 0.4 | 1.2 | C | Comparative |
| 1-16 | 20 | 1-2 FAS 0.35 | ATC 0.6 | 0.9 | B | Comparative |
| 1-17 | 20 | 1-2 FAS 0.35 | ATC 0.65 | 0.8 | A | Comparative |
| 1-18 | 20 | 1-2 FAS 0.35 | ATC 0.70 | 0.3 | A | Invention |
| 1-19 | 20 | 1-2 FAS 0.35 | ATC 0.90 | 0.3 | A | Invention |
| 1-20 | 20 | 1-2 FAS 0.35 | ATC 1.5 | 0.3 | A | Invention |
| 1-21 | 60 | 1-2 FAS 0.35 | ATS 1.2 | 0.3 | C | Comparative |
| 1-22 | 45 | 1-2 FAS 0.35 | ATS 1.2 | 0.3 | C | Comparative |
| 1-23 | 35 | 1-2 FAS 0.35 | ATS 1.2 | 0.3 | B | Comparative |
| 1-24 | 30 | 1-2 FAS 0.35 | ATS 1.2 | 0.3 | A | Invention |
| 1-25 | 25 | 1-2 FAS 0.35 | ATS 1.2 | 0.3 | A | Invention |
| 1-26 | 20 | 1-2 FAS 0.35 | ATS 1.2 | 0.4 | A | Invention |
| 1-27 | 10 | 1-2 FAS 0.35 | ATS 1.2 | 0.5 | A | Invention |
| 1-28 | 20 | 1-4 FAS 0.1 | ATS 1.2 | 1.2 | C | Comparative |
| 1-29 | 20 | 1-4 FAS 0.15 | ATS 1.2 | 0.9 | C | Comparative |
| 1-30 | 20 | 1-4 FAS 0.17 | ATS 1.2 | 0.6 | B | Comparative |
| 1-31 | 20 | 1-4 FAS 0.20 | ATS 1.2 | 0.3 | A | Invention |
| 1-32 | 20 | 1-4 FAS 0.25 | ATS 1.2 | 0.3 | A | Invention |
| 1-33 | 20 | 1-4 FAS 0.35 | ATS 1.2 | 0.3 | A | Invention |
| 1-34 | 20 | 1-4 FAS 0.40 | ATS 1.2 | 0.3 | A | Invention |
| 1-35 | 20 | 1-4 FAS 0.35 | ATS 0.4 | 1.6 | C | Comparative |
| 1-36 | 20 | 1-4 FAS 0.35 | ATS 0.6 | 1.0 | C | Comparative |
| 1-37 | 20 | 1-4 FAS 0.35 | ATS 0.65 | 0.8 | C | Comparative |
| 1-38 | 20 | 1-4 FAS 0.35 | ATS 0.70 | 0.3 | A | Invention |
| 1-39 | 20 | 1-4 FAS 0.35 | ATS 0.90 | 0.3 | A | Invention |
| 1-40 | 20 | 1-4 FAS 0.35 | ATS 1.5 | 0.3 | A | Invention |
| 1-41 | 20 | 1-4 FAS 0.35 | ATS 3.0 | 0.3 | A | Invention |
| 1-42 | 20 | 1-4 FAS 0.35 | ATC 0.4 | 1.0 | C | Comparative |
| 1-43 | 20 | 1-4 FAS 0.35 | ATC 0.6 | 0.8 | B | Comparative |
| 1-44 | 20 | 1-4 FAS 0.35 | ATC 0.65 | 0.7 | A | Comparative |
| 1-45 | 20 | 1-4 FAS 0.35 | ATC 0.70 | 0.3 | A | Invention |
| 1-46 | 20 | 1-4 FAS 0.35 | ATC 0.90 | 0.3 | A | Invention |
| 1-47 | 20 | 1-4 FAS 0.35 | ATC 1.5 | 0.3 | A | Invention |
| 1-48 | 60 | 1-4 FAS 0.35 | ATS 1.2 | 0.3 | C | Comparative |
| 1-49 | 45 | 1-4 FAS 0.35 | ATS 1.2 | 0.3 | C | Comparative |
| 1-50 | 35 | 1-4 FAS 0.35 | ATS 1.2 | 0.3 | B | Comparative |
| 1-51 | 30 | 1-4 FAS 0.35 | ATS 1.2 | 0.3 | A | Invention |
| 1-52 | 25 | 1-4 FAS 0.35 | ATS 1.2 | 0.3 | A | Invention |
| 1-53 | 20 | 1-4 FAS 0.35 | ATS 1.2 | 0.3 | A | Invention |
| 1-54 | 10 | 1-4 FAS 0.35 | ATS 1.2 | 0.3 | A | Invention |
| 1-55 | 20 | 1-1 FAS 0.1 | ATS 1.2 | 2.5 | C | Comparative |
| 1-56 | 20 | 1-1 FAS 0.15 | ATS 1.2 | 1.5 | C | Comparative |
| 1-57 | 20 | 1-1 FAS 0.17 | ATS 1.2 | 1.2 | B | Comparative |
| 1-58 | 20 | 1-1 FAS 0.20 | ATS 1.2 | 0.6 | A | Invention |
| 1-59 | 20 | 1-1 FAS 0.25 | ATS 1.2 | 0.4 | A | Invention |
| 1-60 | 20 | 1-1 FAS 0.35 | ATS 1.2 | 0.3 | A | Invention |
| 1-61 | 20 | 1-1 FAS 0.40 | ATS 1.2 | 0.3 | A | Invention |
| 1-62 | 20 | 1-1 FAS 0.35 | ATS 0.4 | 3.2 | C | Comparative |
| 1-63 | 20 | 1-1 FAS 0.35 | ATS 0.6 | 1.7 | C | Comparative |
| 1-64 | 20 | 1-1 FAS 0.35 | ATS 0.65 | 1.2 | B | Comparative |
| 1-65 | 20 | 1-1 FAS 0.35 | ATS 0.70 | 0.5 | A | Invention |
| 1-66 | 20 | 1-1 FAS 0.35 | ATS 0.90 | 0.3 | A | Invention |
| 1-67 | 20 | 1-1 FAS 0.35 | ATS 1.5 | 0.3 | A | Invention |
| 1-68 | 20 | 1-1 FAS 0.35 | ATS 3.0 | 0.3 | A | Invention |
| 1-69 | 20 | 1-1 FAS 0.35 | ATS 1.2 | 0.3 | C | Comparative |
| 1-70 | 45 | 1-1 FAS 0.35 | ATS 1.2 | 0.3 | B | Comparative |
| 1-71 | 35 | 1-1 FAS 0.35 | ATS 1.2 | 0.3 | A | Comparative |
| 1-72 | 30 | 1-1 FAS 0.35 | ATS 1.2 | 0.3 | A | Invention |
| 1-73 | 35 | 1-1 FAS 0.35 | ATS 1.2 | 0.3 | A | Invention |
| 1-74 | 20 | 1-1 FAS 0.35 | ATS 1.2 | 0.4 | A | Invention |

TABLE 1-continued

In the table: FAS means ferric ammonium salt
ATS means ammonium thiosulfate
ATC means ammonium thiocyanate

| Sample No. | Bleach-fixing time (sec.) | Bleaching agent (mol/l) | Fixer (mol/l) | Residual silver (mg/100 cm²) | Reticulation | Remark |
|---|---|---|---|---|---|---|
| 1-75 | 10 | 1-1 FAS 0.35 | ATS 1.2 | 0.5 | A | Invention |

As is obvious from Table 1, it can be understood that reticulations can be diminished and no problem is raised in desilvering characteristics notwithstanding in a rapid processing, provided ferric organic acid complex salt as a bleaching agent is used in an amount of not less than 0.2 mol per liter, a fixer for silver halides is used in an amount of not less than 0.7 mol per liter, and a bleach-fixing time is not longer than 30 seconds.

EXAMPLE 2

An internal latent image-forming type emulsion Em-1 as prepared in the following manner.

While an aqueous gelatin solution was being kept at 50° C., both of an aqueous silver nitrate solution and an aqueous potassium bromide and sodium chloride solution having a mol-ratio of KBr:NaCl=20:80 were added therein at the same time in a controlled double-jet precipitation method, and thereby a cubic emulsion having an average grain-size of 0.38 μm was obtained. The resulting core emulsion was added with sodium thiosulfate and potassium chlorate, and the mixture was then chemically ripened at 55° C. for 120 minutes. The resulting emulsion was named Emulsion A.

Emulsion A serving as cores was further added with both of an aqueous silver nitrate solution and an aqueous potassium bromide and sodium chloride solution having a mol-ratio of KBr:NaCl=10:90 at the same time so as to make tetradecahedral grains having an average grain-size of 0.50 μm. The resulting emulsion was named Emulsion F.

Emulsion F was further added with sodium thiosulfate and chemically sensitized. After completing the chemical sensitization. 1-phenyl-5-mercaptotetrazole was added in an amount of 9 mg per mol of silver halides used.

Using the above-mentioned internal latent image-forming type emulsion Em-1, the following light-sensitive material was prepared.

Preparation of Internal Latent Image-Forming Type Emulsion

The following layers were coated on a polyethylene-laminated paper support in order from the support, so that a direct-positive type light-sensitive material was prepared.

Layer 1

A Cyan-Forming Red-Sensitive Silver Halide Emulsion Layer, Which Was Prepared in the Following Manner 2,4-dichloro-3-methyl-6-[α-(2,4-di-tert-amylphenoxy)butylamidolphenol of 85 g that is cyan coupler, 1.8 g of 2,5-di-tert-octylhydroquinone, 50 g of tricresyl phosphate 190 g of paraffin, and 50 g of ethyl acetate, were mixedly dissolved. The resulting mixture was added to a gelatin solution containing sodium dodecylbenzenesulfonate and dispersed. Then the internal latent image-forming type silver halide emulsion Em-1 which had been sensitized with sensitizing dye III in an amount of $3.4\times10^{-5}$ mol per mol of the silver halides used was added to the dispersion. The resulting emulsion was so coated as to make the contents of silver, AI dye I and the coupler be 410 mg/m², 19 mg/m² and 350 mg/m², respectively.

Layer 2

An Interlayer

This layer was prepared by coating 100 ml of a 2.5% gelatin solution containing 5 g of grey colloidal silver and 10 g of 2,5-di-tert-octyl hydroquinone which had been dissolved in dibutyl phthalate and dispersed so as to make the colloidal silver content be 380 mg/m².

Layer 3

A Magenta-Forming Green-Sensitive Silver Halide Emulsion Layer, Which Was Prepared in the Following Manner 1-(2,4,6-trichlorophenyl)-3-(2-chloro-5-octadecylsuccinimidoanilino)-5-pyrazolone of 100 g that is magenta coupler, 5 g of 2,5-di-tert-octyl hydroquinone, 48 g of Sumilizer-MDP manufactured by Sumitomo Chemical Industries Co., 200 g of paraffin, 100 g of dibutyl phthalate, and 50 g of ethyl acetate, were mixedly dissolved. The resulting mixture was added to a gelatin solution containing sodium dodecylbenzenesulfonate and dispersed. Then the internal latent image-forming type silver halide emulsion Em-1 which had been sensitized with sensitizing dye II in an amount of $3.0\times10^{-4}$ mol per mol of the silver halides used was used to the dispersion. The resulting emulsion was so coated as to make the contents of silver, AI dye II and the coupler be 380 mg/m², 20 mg/m², and 390 mg/m², respectively.

Layer 4

A Yellow Filter Layer

This layer was prepared by coating a 2.5% gelatin solution containing 5 g of yellow colloidal silver and 5 g of 2,5-di-tert-octyl hydroquinone which had been dispersed in dibutyl phthalate and dispersed in the solution so as to make the colloidal silver content be 200 mg/m².

Layer 5

A Yellow-Forming Blue-Sensitive Silver Halide Emulsion Layer, Which Was Prepared in the Following Manner α-[4-(1-benzyl-2-phenyl-3,5-dioxo-1,2,4-triazolidinyl)]-αpivalyl-2-chloro-5-[γ-(2,4-di-tert-amylphenoxy)butylamido]ace toanilide of 120 g that is yellow coupler, 3.5 g of 2,5-di-tert-octyl hydroquinone, 200 g of paraffin, 100 g Tinuvin manufactured by ciba Geigy AG., 90 g of dibutyl phthalate, and 70 ml of ethyl acetate, were mixedly dissolved. The resulting mixture was added to a gelatin solution containing sodium dodecylbenzenesulfonate and dispersed. Then the internal latent image-forming type silver halide emulsion Em-1 which had been sensitized with sensitizing dye I in an amount of $3.0\times10^{-4}$ mol per mol of the silver halides used was added to the dispersion. The resulting emulsion was so coated as to make the contents of silver and the coupler be 390 mg/m² and 400 mg/m², respectively.

Layer 6

A Protective Layer

This layer was prepared by coating gelatin so as to make the content of the gelating be 210 mg/m$^2$.

To all the above-mentioned layers each, saponin was added to serve as a coating aid. Sodium 2,4-dichloro-6-hydroxy-S-triazine was added to serve as a hardener into each of layers 2. 4, and 6 so as to make the content thereof be 0.02 g per g of gelatin.

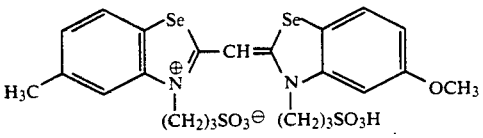

Sensitizing Dye I

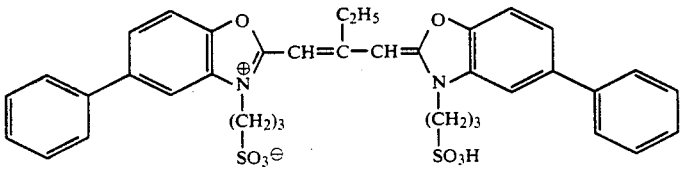

Sensitizing Dye II

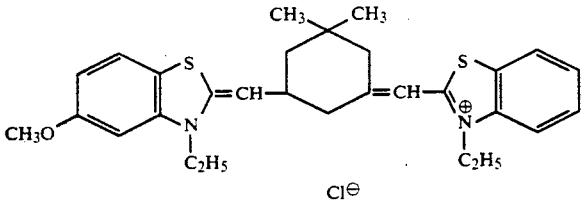

Sensitizing Dye III

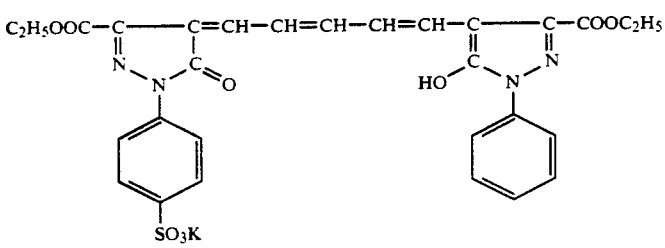

AI I

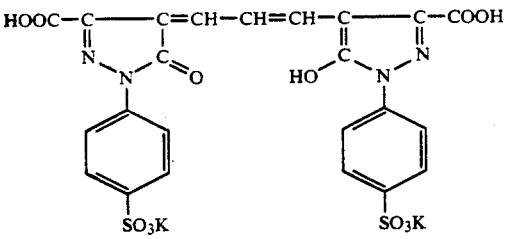

AI II

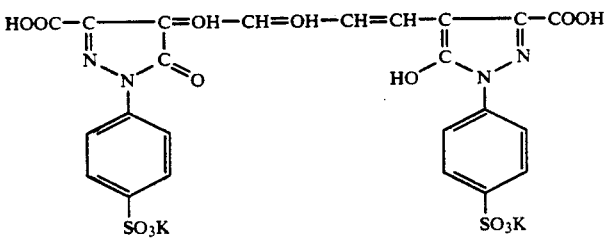

AI III

The above-mentioned light-sensitive material was exposed to light through an optical wedge and was then processed in the following processing steps.

| Processing step at 45° C. | Processing time |
|---|---|
| Dipping in Color Developer | 8 seconds |
| Color developing with overall uniform exposure to 1-lux-light for initial 10 seconds | 20 seconds |
| Bleach-fixing | See Table 2 |
| Stabilizing | 20 seconds in a single tank |
| Drying | 60 seconds at 60–80° C. |

The compositions of the processing solutions were as follows.

| Color Developer | |
|---|---|
| Pure water | 800 ml |
| Diethylhydroxylamine sulfate | 2.5 g |
| Potassium bromide | 0.3 g |
| Sodium chloride | 1.0 g |
| Potassium sulfite | 1.0 g |
| Triethanolamine | 2.0 g |
| 3-methyl-4-amino-N-ethyl-N-(β-methanesulfoneamidoethyl)-aniline sulfate | 7.5 g |
| 1-hydroxyethylidene-1,1-diphosphanate, in an aqueous 60% solution | 1.5 ml |
| Magnesium chloride | 0.3 g |
| Potassium carbonate | 32 g |
| Potassium carbonate, a fluorescent whitening agent manufactured by Shin Nisso Chemical Co. | 2.0 g |
| Added pure water to make | 1 liter |
| Adjusted pH with a 20% potassium hydroxide or 10% dilute sulfuric acid solution to | pH 10.1 |
| Bleach-fixer | |
| Ferric ammonium salt having Formula I | See Table 2 |
| Ethylenediaminetetraacetic acid | 3 g |
| Fixer | See Table 2 |

-continued

| | |
|---|---|
| Ammonium sulfite in a 20% solution | 27.5 ml |
| 2-amino-5-mercapto-1,3,4-thiazole | 1.0 g |
| Added water to make | 1 liter |
| Adjusted pH with aqueous ammonia or acetic acid to | pH 7.0 |
| Stabilizer | |
| Orthophenylphenol | 0.2 g |
| hydroxyethylidene-1,1-diphosphonic acid in a 60% solution | 5.0 g |
| Aqueous ammonia | 3.0 g |
| Add water to make | 1 liter |
| Adjust pH with aqueous ammonia or acetic acid to | pH 7.6 |

After the processing was completed, the residual silver content of each sample was measured and the reticulation of each sample was so observed as to evaluate the degrees thereof. As the results of the evaluations, the samples were ranked A when no reticulation was found, B when a few reticulations were found, and C when too many reticulations were found to put into practical use, respectively. The results of the evaluations of the reticulations are shown in Table 1.

TABLE 2

| Sample No. | Bleach-fixing time (sec.) | Exemplified compound 1 (mol/l) | Exemplified compound 2 (mol/l) | Residual silver (mg/100 cm$^2$) | Reticulation | Remark |
|---|---|---|---|---|---|---|
| 2-1 | 20 | 1-2 FAS 0.1 | ATS 1.2 | 2.2 | C | Comp. |
| 2-2 | 20 | 1-2 FAS 0.15 | ATS 1.2 | 1.4 | C | Comp. |
| 2-3 | 20 | 1-2 FAS 0.17 | ATS 1.2 | 1.2 | B | Comp. |
| 2-4 | 20 | 1-2 FAS 0.20 | ATS 1.2 | 0.5 | A | Inv. |
| 2-5 | 20 | 1-2 FAS 0.25 | ATS 1.2 | 0.3 | A | Inv. |
| 2-6 | 20 | 1-2 FAS 0.35 | ATS 1.2 | 0.3 | A | Inv. |
| 2-7 | 20 | 1-2 FAS 0.40 | ATS 1.2 | 0.3 | A | Inv. |
| 2-8 | 20 | 1-2 FAS 0.35 | ATS 0.4 | 3.3 | C | Comp. |
| 2-9 | 20 | 1-2 FAS 0.35 | ATS 0.6 | 1.7 | C | Comp. |
| 2-10 | 20 | 1-2 FAS 0.35 | ATS 0.65 | 1.0 | B | Comp. |
| 2-11 | 20 | 1-2 FAS 0.35 | ATS 0.70 | 0.5 | A | Inv. |
| 2-12 | 20 | 1-2 FAS 0.35 | ATS 0.90 | 0.3 | A | Inv. |
| 2-13 | 20 | 1-2 FAS 0.35 | ATS 1.5 | 0.3 | A | Inv. |
| 2-14 | 20 | 1-2 FAS 0.35 | ATS 3 | 0.3 | A | Inv. |
| 2-15 | 20 | 1-2 FAS 0.35 | ATC 0.4 | 1.4 | C | Comp. |
| 2-16 | 20 | 1-2 FAS 0.35 | ATC 0.6 | 0.9 | B | Comp. |
| 2-17 | 20 | 1-2 FAS 0.35 | ATC 0.65 | 0.8 | A | Comp. |
| 2-18 | 20 | 1-2 FAS 0.35 | ATC 0.70 | 0.3 | A | Inv. |
| 2-19 | 20 | 1-2 FAS 0.35 | ATC 0.90 | 0.3 | A | Inv. |
| 2-20 | 20 | 1-2 FAS 0.35 | ATC 1.5 | 0.3 | A | Inv. |
| 2-21 | 60 | 1-2 FAS 0.35 | ATS 1.2 | 0.3 | C | Comp. |
| 2-22 | 45 | 1-2 FAS 0.35 | ATS 1.2 | 0.3 | C | Comp. |
| 2-23 | 35 | 1-2 FAS 0.35 | ATS 1.2 | 0.3 | B | Comp. |
| 2-24 | 30 | 1-2 FAS 0.35 | ATS 1.2 | 0.3 | A | Inv. |
| 2-25 | 25 | 1-2 FAS 0.35 | ATS 1.2 | 0.3 | A | Inv. |
| 2-26 | 20 | 1-2 FAS 0.35 | ATS 1.2 | 0.4 | A | Inv. |
| 2-27 | 10 | 1-2 FAS 0.35 | ATS 1.2 | 0.5 | A | Inv. |
| 2-28 | 20 | 1-4 FAS 0.1 | ATS 1.2 | 1.4 | C | Comp. |
| 2-29 | 20 | 1-4 FAS 0.15 | ATS 1.2 | 0.9 | C | Comp. |
| 2-30 | 20 | 1-4 FAS 0.17 | ATS 1.2 | 0.6 | B | Comp. |
| 2-31 | 20 | 1-4 FAS 0.20 | ATS 1.2 | 0.3 | A | Inv. |
| 2-32 | 20 | 1-4 FAS 0.25 | ATS 1.2 | 0.3 | A | Inv. |
| 2-33 | 20 | 1-4 FAS 0.35 | ATS 1.2 | 0.3 | A | Inv. |
| 2-34 | 20 | 1-4 FAS 0.40 | ATS 1.2 | 0.3 | A | Inv. |
| 2-35 | 20 | 1-4 FAS 0.35 | ATS 0.4 | 1.8 | C | Comp. |
| 2-36 | 20 | 1-4 FAS 0.35 | ATS 0.6 | 1.0 | C | Comp. |
| 2-37 | 20 | 1-4 FAS 0.35 | ATS 0.65 | 0.8 | C | Comp. |
| 2-38 | 20 | 1-4 FAS 0.35 | ATS 0.70 | 0.3 | A | Inv. |
| 2-39 | 20 | 1-4 FAS 0.35 | ATS 0.90 | 0.3 | A | Inv. |
| 2-40 | 20 | 1-4 FAS 0.35 | ATS 1.5 | 0.3 | A | Inv. |
| 2-41 | 20 | 1-4 FAS 0.35 | ATS 3.0 | 0.3 | A | Inv. |
| 2-42 | 20 | 1-4 FAS 0.35 | ATS 0.4 | 1.0 | C | Comp. |
| 2-43 | 20 | 1-4 FAS 0.35 | ATC 0.6 | 0.8 | B | Comp. |
| 2-44 | 20 | 1-4 FAS 0.35 | ATC 0.65 | 0.7 | A | Comp. |
| 2-45 | 20 | 1-4 FAS 0.35 | ATC 0.70 | 0.3 | A | Inv. |
| 2-46 | 20 | 1-4 FAS 0.35 | ATC 0.90 | 0.3 | A | Inv. |
| 2-47 | 20 | 1-4 FAS 0.35 | ATC 1.5 | 0.3 | A | Inv. |
| 2-48 | 60 | 1-4 FAS 0.35 | ATS 1.2 | 0.3 | C | Comp. |
| 2-49 | 45 | 1-4 FAS 0.35 | ATS 1.2 | 0.3 | C | Comp. |

TABLE 2-continued

| Sample No. | Bleach-fixing time (sec.) | Exemplified compound 1 (mol/l) | Exemplified compound 2 (mol/l) | Residual silver (mg/100 cm²) | Reticulation | Remark |
|---|---|---|---|---|---|---|
| 2-50 | 35 | 1-4 FAS 0.35 | ATS 1.2 | 0.3 | B | Comp. |
| 2-51 | 30 | 1-4 FAS 0.35 | ATS 1.2 | 0.3 | A | Inv. |
| 2-52 | 25 | 1-4 FAS 0.35 | ATS 1.2 | 0.3 | A | Inv. |
| 2-53 | 20 | 1-4 FAS 0.35 | ATS 1.2 | 0.3 | A | Inv. |
| 2-54 | 10 | 1-4 FAS 0.35 | ATS 1.2 | 0.3 | A | Inv. |

In the table:
FAS means ferric ammonium salt
ATS means ammonium thiosulfate
ATC means ammonium thiocyanate
Comp. means Comparative Sample
Inv. means Sample of Invention As is obvious from Table 2, it can be understood that almost no reticulations can be produced and excellent desilvering characteristics can be displayed, provided, a bleaching agent is used in an amount of not less than 0.2 mol per liter, a solubilizer for silver halides is used in an amount of not less than 0.7 mol per liter, and a bleach-fixing time is not longer than 30 seconds.

EXAMPLE 3

The experiments were tried in the same manner as in Example 1, except that the equivalent mol of a compound having Formula B-I, a compound having Formula D, glycine, or hydroxylamine sulfate was added in place of the hydroxylamine of the color developer used in Experiment No. 1-5 of Example 1, and the pH was adjusted with potassium hydroxide to be pH 10.20, provided, A-2/triethanolamine and glycine/triethanolamine were each added in the same mol amounts as those of others. The results thereof are shown in Table 3.

TABLE 3

| Experiment No. | Bleach-fixing time (Sec.) | Formula B-I | Residual silver content (mg/100 cm²) | Reticulation |
|---|---|---|---|---|
| 3-1 | 20 | Hydroxylamine sulfate | 0.6 | B |
| 3-2 | 20 | Triethanolamine | 0.3 | A |
| 3-3 | 20 | A-2 | 0.3 | A |
| 3-4 | 20 | A-10 | 0.3 | A |
| 3-5 | 20 | A-21 | 0.2 | A |
| 3-6 | 20 | A-18 | 0.2 | A |
| 3-7 | 20 | A-27 | 0.3 | A |
| 3-8 | 20 | A-11 | 0.3 | A |
| 3-9 | 20 | Glycine | 0.3 | A |
| 3-10 | 20 | A-2/TEA | 0.2 | A |
| 3-11 | 20 | Glycine/TEA | 0.3 | A |

As is obvious from the results shown in Table 3, the objects of the invention can be displayed more effectively in the use of the compound having Formula B-I, the compound having Formula D and glycine in combination than in the use of hydroxylamine sulfate.

EXAMPLE 4

The samples were prepared in the same manner as in Example 1, except that the silver chloride contents of the silver halide emulsions each used in Example 1 were replaced by those shown in Table 4. The resulting samples were processed with the following processing steps and processing solutions. The residual silver contents. reticulations and edge-stains thereof were then evaluated in the same manner as in Example 1, provided, the edge-stains were evaluated by measuring the blue-reflection density of a 3-meter-wound edge portions by means of a densitometer PDS-65 manufactured by Konica Corporation. The results indicated that the higher the blue reflection density was, the more the worse the edge stains were.

| Processing step | Processing temperature | Processing time |
|---|---|---|
| 1 Color developing | 45° C. | 10 seconds |
| 2 Bleach-fixing | 45° C. | See Table 4 |
| 3 Stabilizing | 50° C. | 20 seconds |
| 4 Drying | 60 to 80° C. | 30 seconds |

The compositions of the color developer, bleach-fixer, and stabilizer each used therein were as follows.

| | |
|---|---|
| Color developer | |
| Potassium sulfite | 0.3 g |
| Potassium bromide | 0.02 g |
| Sodium chloride | 3.0 g |
| Potassium carbonate | 30.0 g |
| Glycine | 10 g |
| Diethylhydroxylamine | 8.0 g |
| Ethylenediaminetetramethylene phosphonate | 2.0 g |
| 3-methyl-4-amino-N-ethyl-N-(β-methane sulfonamidoethyl)-aniline sulfate | 7.5 g |
| Triethanolamine | 10 g |
| Fluorescent whitening agent, Kaycoll-PK-C manufactured by Nippon Soda Co. | 1.0 g |
| Add water to make | 1 liter |
| Adjust pH with potassium hydroxide to | pH 10.10 |
| Bleach-fixer | |
| 1-1 ferric ammonium salt having Formula 1 | 0.3 mol |
| Ethylenediaminetetraacetic acid | 3 g |
| Ammonium thiosulfate | 1.0 mol |
| Ammonium sulfite in a 40% solution | 27.5 ml |
| 2-amino-5-mercapto-1,3,4-thiazole | 1.0 g |
| Add water to make | 1 liter |
| Adjust pH with potassium carbonate to | pH 5.5 |
| Stabilizer | |
| Hydroxyethylidene-1,1-diphosphonate | 1.0 g |
| Zinc sulfate heptahydrate | 3.0 g |
| Polyvinyl pyrolidone | 0.5 g |
| Bismuth chloride hexahydrate | 0.2 g |
| Ammonium hydroxide in an aqueoud 28% solution | 3 g |
| Adjust pH with sulfuric acid and potassium hydroxide to | pH 7.8 |

The results thereof are shown in Table 4.

TABLE 4

| Experiment No. | Cl content of AgBrCl (mol %) | Bleach-fixing time (sec) | Residual silver amt. (mg/100 cm$^2$) | Reticulation grade | Edge-stain (Blue-refl density) | Remark |
|---|---|---|---|---|---|---|
| 4-1 | 20 | 90 | 0.3 | C | 0.13 | Comp. |
| 4-2 | 20 | 40 | 0.5 | C | 0.10 | Comp. |
| 4-3 | 20 | 30 | 0.8 | B | 0.08 | Comp. |
| 4-4 | 20 | 20 | 1.4 | A | 0.06 | Comp. |
| 4-5 | 20 | 10 | 1.9 | A | 0.06 | Comp. |
| 4-6 | 70 | 90 | 0.3 | C | 0.13 | Comp. |
| 4-7 | 70 | 40 | 0.3 | C | 0.10 | Comp. |
| 4-8 | 70 | 30 | 0.4 | B | 0.08 | Comp. |
| 4-9 | 70 | 20 | 0.7 | A | 0.06 | Comp. |
| 4-10 | 70 | 10 | 1.0 | A | 0.06 | Comp. |
| 4-11 | 90 | 90 | 0.3 | C | 0.13 | Comp. |
| 4-12 | 90 | 40 | 0.3 | C | 0.10 | Comp. |
| 4-13 | 90 | 30 | 0.3 | B | 0.08 | Inv. |
| 4-14 | 90 | 20 | 0.3 | A | 0.06 | Inv. |
| 4-15 | 90 | 10 | 0.3 | A | 0.06 | Inv. |
| 4-16 | 100 | 90 | 0.3 | C | 0.13 | Comp. |
| 4-17 | 100 | 40 | 0.3 | C | 0.10 | Comp. |
| 4-18 | 100 | 30 | 0.3 | A | 0.08 | Inv. |
| 4-19 | 100 | 20 | 0.3 | A | 0.06 | Inv. |
| 4-20 | 100 | 10 | 0.3 | A | 0.06 | Inv. |

As is obvious form the results shown in Table 4, reticulations and edge-stains can hardly be produced when using the bleach-fixer of the invention even if the bleaching agent and fixer are each used at a high temperature and in a high concentration, provided, the processing time is not longer than 30 seconds. It is also understood that, when using a highly concentrated silver chloride-containing emulsion, the desilvering characteristics can be displayed excellently and a rapid processing within 30 seconds can be carried out satisfactorily.

EXAMPLE 5

The samples were prepared in the same manner as in Example 4, except that the samples used in Experiment No. 4-4 and No. 4-19 were used, and the bleaching agents and fixers were replaced by those shown in Table 5. The evaluations were made in the same manner as in Example 4.

The results thereof are shown in Table 5.

TABLE 5

| Experiment No. | Cl content of AgBrCl (mol %) | Bleach-fixing time (sec) | Concentration (mol/l) Bleaching agent | Fixer | Residual silver amt. (mg/100 cm$^2$) | Retucu-lation grade | Edge-stain (Blue-refl density) | Remark |
|---|---|---|---|---|---|---|---|---|
| 5-1 | 20 | 15 | 0.25 | 0.5 | 1.6 | C | 0.06 | Comp. |
| 5-2 | 20 | 15 | 0.25 | 0.7 | 1.2 | B | 0.06 | Comp. |
| 5-3 | 20 | 15 | 0.25 | 1.0 | 1.4 | A | 0.06 | Comp. |
| 5-4 | 20 | 15 | 0.25 | 2.0 | 1.5 | A | 0.07 | Comp. |
| 5-5 | 20 | 15 | 0.15 | 1.0 | 1.6 | C | 0.06 | Comp. |
| 5-6 | 20 | 15 | 0.20 | 1.0 | 1.4 | B | 0.06 | Comp. |
| 5-7 | 20 | 15 | 0.30 | 1.0 | 1.6 | A | 0.07 | Comp. |
| 5-8 | 20 | 15 | 0.50 | 1.0 | 1.7 | A | 0.08 | Comp. |
| 5-9 | 100 | 15 | 0.25 | 0.5 | 0.7 | C | 0.06 | Comp. |
| 5-10 | 100 | 15 | 0.25 | 0.7 | 0.5 | A | 0.06 | Inv. |
| 5-11 | 100 | 15 | 0.25 | 1.0 | 0.3 | A | 0.06 | Inv. |
| 5-12 | 100 | 15 | 0.25 | 2.0 | 0.3 | A | 0.07 | Inv. |
| 5-13 | 100 | 15 | 0.15 | 1.0 | 0.7 | C | 0.06 | Comp. |
| 5-14 | 100 | 15 | 0.20 | 1.0 | 0.5 | A | 0.06 | Inv. |
| 5-15 | 100 | 15 | 0.30 | 1.0 | 0.3 | A | 0.07 | Inv. |
| 5-16 | 100 | 15 | 0.50 | 1.0 | 0.3 | A | 0.08 | Inv. |

According to Table 5, in the case of the silver halide color light-sensitive material applied with a highly silver bromide containing emulsion having a chloride content of 20 mol %, it is obviously found that the desilvering characteristics are rather deteriorated as the concentration of a bleaching agent or a fixer is increased, though the desilvering characteristics may be improved in a certain concentration level such as in the case of Experimental Samples No. 5-2 and No. 5-6. It is also found in this case that there are too many silver residual amounts to put to practical use. On the other hand, in the case of a silver halide color light-sensitive material applied with a highly concentrated silver chloride emulsion having a chloride content of 100 mol %, it is found that the desilvering characteristics can be improved by increasing the concentration of a bleaching agent or a fixer, and the desilvering characteristics can be kept excellent notwithstanding a rapid processing such as 15 second-processing.

EXAMPLE 6

The color light-sensitive materials were prepared, Couplers Y-1 and Y-2 used in Example 5 were replaced by the following couplers for one, and Coupler M-1 was replaced by the following couplers for the other, respectively. The resulting color light-sensitive materials were evaluated in the same manner as in Example 1. The results thereof indicated that the residual silver amounts thereof were deteriorated by 0.01 to 0.0Z. though the reticulations and edge-stains remained unchanged.

Y'-1
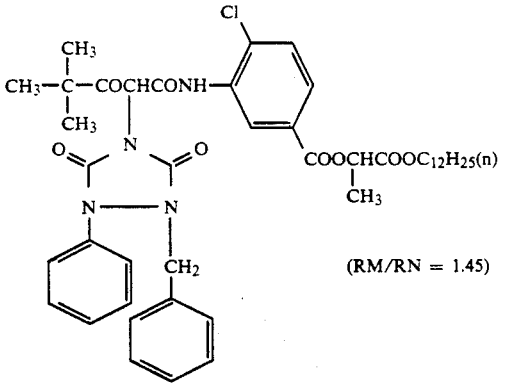
(RM/RN = 1.45)
Y'-2
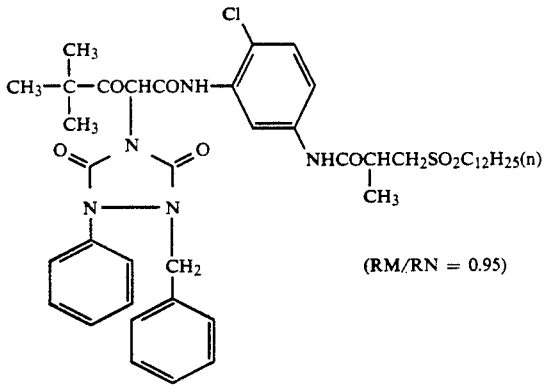
(RM/RN = 0.95)
Y'-3
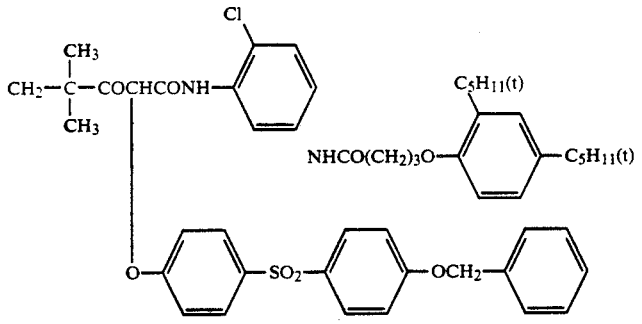
(RM/RN = 0.65)
Y'-4
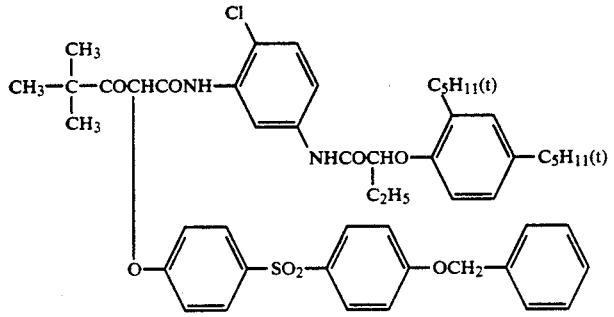
(RM/RN = 0.92)

-continued
Y'-5
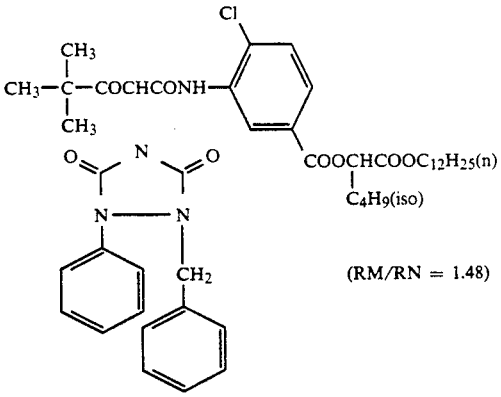
(RM/RN = 1.48)
M'-1
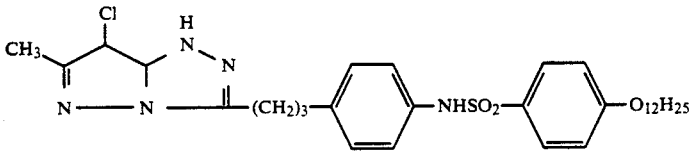
M'-2
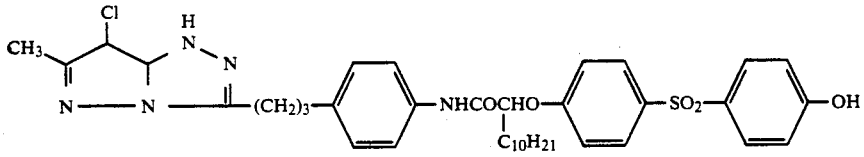
M'-3
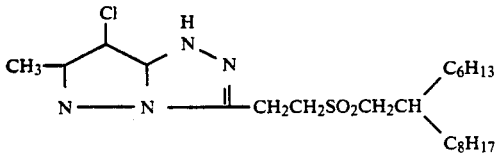
M'-4
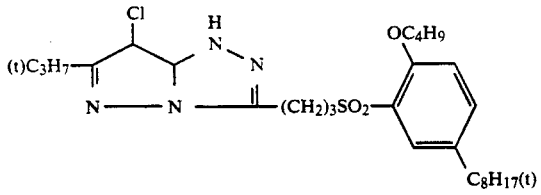
M'-5
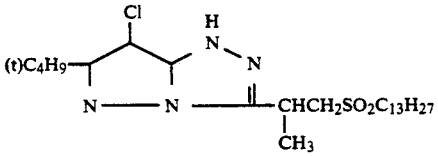
M'-6
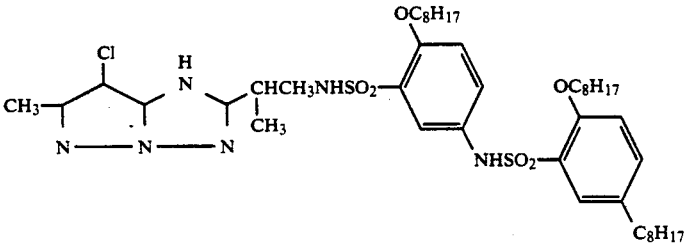
M'-7
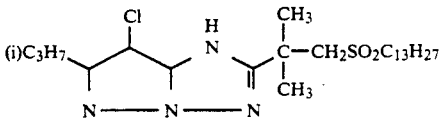

EXAMPLE 7

The silver halide color light-sensitive materials were prepared by adding 2 mg/m$^2$ each of the following heterocyclic compounds into the 1st, 3rd and 5th layers of the silver halide color light-sensitive material used in Example 1. The resulting light-sensitive materials were evaluated in the same manner as in Example 1. From the results thereof, it was found that the desilvering characteristics can be improved by the order of 0.01 to 0.03.

S-1

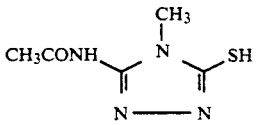

S-2

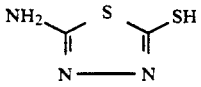

S-3

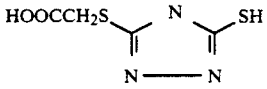

S-4

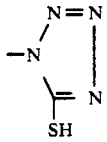

S-5

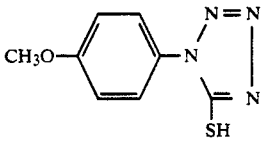

S-6

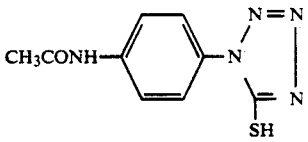

S-7

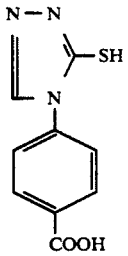

EXAMPLE 8

Experiments Samples Nos. 4-5, 4-10, 4-15 and 4-20 of Example 4 were processed in the same manner as in Example 4, except that the chloride, i.e., ammonium chloride, of the bleach-fixer was changed to those shown in Table 6 and the bleach-fixing time was changed to 7 seconds. The resulting desilvering characteristics were evaluated in the same manner as in Example 4.

The results thereof are shown in Table 6.

TABLE 6

| Experiment No. | Cl content of AgBrCl (mol %) | Concentration of chloride, $NH_4Cl$ (mol) | Residual silver amt. (mg/100 cm$^2$) |
|---|---|---|---|
| 6-1 | 20 | $1 \times 10^{-2}$ | 2.1 |
| 6-2 | 20 | $2 \times 10^{-2}$ | 2.1 |
| 6-3 | 20 | $3 \times 10^{-2}$ | 2.1 |
| 6-4 | 20 | $1 \times 10^{-1}$ | 2.1 |
| 6-5 | 20 | $5 \times 10^{-1}$ | 2.2 |
| 6-6 | 70 | $1 \times 10^{-2}$ | 1.3 |
| 6-7 | 70 | $2 \times 10^{-2}$ | 1.3 |
| 6-8 | 70 | $3 \times 10^{-2}$ | 1.3 |
| 6-9 | 70 | $1 \times 10^{-1}$ | 1.3 |
| 6-10 | 70 | $5 \times 10^{-1}$ | 1.3 |
| 6-11 | 90 | $1 \times 10^{-2}$ | 0.6 |
| 6-12 | 90 | $2 \times 10^{-2}$ | 0.4 |
| 6-13 | 90 | $3 \times 10^{-2}$ | 0.3 |
| 6-14 | 90 | $1 \times 10^{-1}$ | 0.3 |
| 6-15 | 90 | $5 \times 10^{-1}$ | 0.3 |
| 6-16 | 100 | $1 \times 10^{-2}$ | 0.6 |
| 6-17 | 100 | $2 \times 10^{-2}$ | 0.3 |
| 6-18 | 100 | $3 \times 10^{-2}$ | 0.3 |
| 6-19 | 100 | $1 \times 10^{-1}$ | 0.3 |
| 6-20 | 100 | $5 \times 10^{-1}$ | 0.3 |

According to Table 6, it is obviously fond that, in the case of the highly silver chloride-containing emulsions distinguishly improved the desilvering characteristics and, in particular, the improvement was emphasized when the silver chloride content was not less than $2 \times 10^{-2}$ mol, though the desilvering characteristics are hardly affected by the conventional types of highly silver bromide containing emulsions even when the silver chloride content thereof is increased. It can, therefore, be said that the bleach-fixers of the invention are suitable for processing a highly concentrated silver chloride emulsion and capable of performing rapid processing.

The reticulations and edge-stains showed a sign of improvement, though a remarkable effect was not displayed even when increasing the chloride concentration.

What is claimed is:

1. A method of processing a silver halide color photographic light sensitive material comprising:

developing said light-sensitive material with a color developer and bleach-fixing said developed light-sensitive material with a bleach-fixer for a time period of not more than 30 seconds, wherein said bleach-fixer comprises a chloride in an amount of not less than $2 \times 10^{-2}$ mol per liter, wherein said light-sensitive material includes at least one silver halide emulsion layer comprising silver halide grains having a silver chloride content of not less than 80 mol % and said bleach-fixer comprises a ferric organic acid complex in an amount of from 0.25 mol to 1.0 mol per liter of said bleach-fixer and a silver halide fixing agent in an amount of from 0.8 mol to 3.0 mol per liter of said bleach-fixer.

2. The method of claim 1, wherein said bleach-fixer comprises said ferric organic acid complex in an amount of 0.3 mol to 0.8 mol per liter.

3. The method of claim 1, wherein said step for bleach-fixing is performed for a time of within the range of 2 seconds to 30 seconds.

4. The method of claim 3, wherein said step for bleach-fixing is performed for a time of within the range of 3 seconds to 25 seconds.

5. The method of claim 4, wherein said step for bleach-fixing is performed for a time of within the range of 3 seconds to 20 seconds.

6. The method of claim 1, wherein said bleach-fixer comprises said chloride in an amount of not less than $4\times10^{-2}$ mol to 2 mol per liter.

7. The method of claim 1, wherein said silver halide grains have a silver chloride content of not less than 90 mol %.

8. The method of claim 7, wherein said silver halide grains have a silver chloride content of not less than 95 mol %.

9. The method of claim 1, wherein said color developer comprising a color developing agent represented by the following formula:

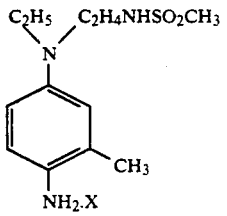

wherein X is sulfuric acid, hydrochloride, p-toluenesulfonic acid, phosphoric acid, nitric acid or triethanolamine.

10. A bleach-fixer for bleach-fixing a silver halide color photographic light-sensitive material in a time period of less than 30 seconds comprising a ferric organic acid complex in an amount of not less than 0.2 mol per liter of said bleach-fixer and a silver halide fixing agent in an amount of not less than 0.7 mol per liter of said bleach fixer, wherein said bleach-fixer comprises a chloride in an amount of not less than $2\times10^{-2}$ mol per liter.

11. The bleach-fixer of claim 10, wherein said bleach-fixer comprises said ferric organic acid complex in an amount of 0.25 mol to 1.0 mol per liter.

12. The bleach-fixer of claim 11, wherein said bleach-fixer comprises said ferric organic acid complex in an amount of 0.3 mol to 0.8 mol per liter.

13. The bleach-fixer of claim 10, wherein said bleach-fixer comprises said silver halide fixing agent in an amount of 0.7 mol to 4.0 mol per liter.

14. The bleach-fixer of claim 13, wherein said bleach-fixer comprises said silver halide fixing agent in an amount of 0.8 mol to 3.0 mol per liter.

15. The bleach-fixer of claim 10, wherein said bleach-fixer comprises said chloride in an amount of $4\times10^{-2}$ mol to 2 mol per liter.

* * * * *

UNITED STATES PATENT AND TRADEMARK OFFICE

CERTIFICATE OF CORRECTION

PATENT NO. : 5,180,656

DATED : January 19, 1993

INVENTOR(S) : Hiroaki KOBAYASHI et al.

It is certified that error appears in the above-identified patent and that said Letters Patent is hereby corrected as shown below:

In the Abstract, line 17 (last line), after "light-sensitive" and before the period insert --material--.

Signed and Sealed this

First Day of March, 1994

Bruce Lehman

*Attest:*

BRUCE LEHMAN

*Attesting Officer*

*Commissioner of Patents and Trademarks*